US005802862A

United States Patent [19]

Eiermann

[11] Patent Number: 5,802,862

[45] Date of Patent: Sep. 8, 1998

[54] METHOD AND APPARATUS FOR LATENT HEAT EXTRACTION WITH COOLING COIL FREEZE PROTECTION AND COMPLETE RECOVERY OF HEAT OF REJECTION IN DX SYSTEMS

[76] Inventor: Kenneth L. Eiermann, 1049 Manchester Cir., Winter Park, Fla. 32792

[21] Appl. No.: 607,335

[22] Filed: Feb. 26, 1996

Related U.S. Application Data

[63] Continuation-in-part of Ser. No. 290,202, Aug. 15, 1994, Pat. No. 5,493,871, which is a continuation-in-part of Ser. No. 8,192, Jan. 25, 1993, Pat. No. 5,337,577, which is a continuation of Ser. No. 791,120, Nov. 12, 1991, Pat. No. 5,181,552.

[51] Int. Cl.[6] ..... F25B 29/00; F25D 17/06

[52] U.S. Cl. ..... 62/173; 62/185; 165/228

[58] Field of Search ..... 62/90, 173, 238.6, 62/185; 165/228

[56] References Cited

U.S. PATENT DOCUMENTS 2,200,118 5/1940 Miller ..... 62/173

4,271,678 6/1981 Liebert ..... 62/173

5,193,352 3/1993 Smith et al. ..... 62/90

*Primary Examiner*—William E. Wayner

*Attorney, Agent, or Firm*—Fay, Sharpe, Beall, Fagan, Minnich & McKee

[57] ABSTRACT

A method and apparatus for improved latent heat extraction combines a run-around coil system with a condenser heat recovery system to enhance the moisture removing capability of a conventional vapor compression air conditioning unit. The run-around coil system exchanges energy between the return and supply air flows of the air conditioning unit. Energy recovered in the condenser heat recovery system is selectively combined with the run-around system energy extracted from the return air flow to reheat the supply air stream for downstream humidity control. A control system regulates the relative proportions of the extracted return air flow energy and recovered heat energy delivered to the reheat coil for efficient control over moisture in the supply air flow. Auxiliary energy in the form of electric heat energy is further added to the recovered heat energy for additional reheat use.

1 Claim, 24 Drawing Sheets

PROTRACTOR
SENSIBLE HEAT
TOTAL HEAT

METHOD AND APPARATUS FOR LATENT HEAT EXTRACTION WITH COOLING COIL FREEZE PROTECTION AND COMPLETE RECOVERY OF HEAT OF REJECTION IN DX SYSTEMS

CROSS REFERENCE TO RELATED APPLICATIONS

This application is a continuation-in-part of application Ser. No. 08/290,202 filed Aug. 15, 1994, now U.S. Pat. No. 5,493,871 which was a continuation-in-part application of application Ser. No. 08/008,192 filed Jan. 25, 1993 now U.S. Pat. No. 5,337,577, which was a continuation of application Ser. No. 07/791,120 filed Nov. 12, 1991, now U.S. Pat. No. 5,181,552.

BACKGROUND OF THE INVENTION

This application pertains to the art of air conditioning methods and apparatus. More particularly, this application pertains to methods and apparatus for efficient control of the moisture content of an air stream which has undergone a cooling process as by flowing through an air conditioning cooling coil or the like. The invention is specifically applicable to dehumidification of a supply air flow into the occupied space of commercial or residential structures. By means of selective combination of extracted return air flow heat energy and recovered refrigerant waste heat energy, the supply air flow is warmed using a reheat coil apparatus. The return air flow entering the air conditioning coil is precooled with a precooling coil in operative fluid communication with the reheat coil. Heating of the occupied space may be effected using the combined reheat and precooling coils in conjunction with an alternative heat source such as electric, solar, or the like and will be described with particular reference thereto. It will be appreciated, through, that the invention has other and broader applications such as cyclic heating applications wherein a supply air flow is heated at the reheat coil irrespective of the instantaneous operational mode of the refrigerant system through the expedient of a thermal energy storage tank or the like.

Conventional air conditioning systems use a vapor compression refrigeration cycle that operates to cool an indoor air stream through the action of heat transfer as the air stream comes in close contact with evaporator type or flooded coil type refrigerant-to-air heat exchangers or coils. Cooling is accomplished by a reduction of temperature as an air stream passes through the cooling coil. This process is commonly referred to as sensible heat removal. A corresponding simultaneous reduction in the moisture content of the air stream typically also occurs to some extent and is known as latent heat removal or more generally called dehumidification. Usually the cooling itself is controlled by means of a thermostat or other apparatus in the occupied space which respond to changes in dry bulb temperature. When controlled in this manner, dehumidification occurs as a secondary effect incidental to the cooling process itself. As such, dehumidification of the indoor air occurs only when there is a demand for reduced temperature as dictated by the thermostat.

To accomplish dehumidification when the thermostat does not indicate a need for cooling, a humidistat is often added to actuate the air conditioning unit in order to remove moisture from the cooled air stream as a "byproduct" function of the cooling. In this mode of operation, heat must be selectively added to the cooled air stream to prevent the conditioned space from over-cooling below the dry bulb set point temperature. This practice is commonly known as "reheat".

Many sources of heat have been used for reheat purposes, such as hydronic hot water with various fuel sources, hydronic heat recovery sources, gas heat, hot gas or hot liquid refrigerant heat, and electric heat. Electric heat is most often used because it is usually the least expensive alternative overall. However, the use of electric heat to provide the reheat energy is proscribed by law in some states, including Florida for example.

In order to conserve energy, it has been suggested to use heat recovered from the return air flow as a source for the reheat in the supply air flow. Accordingly, one method to improve the moisture removal capacity of an air conditioning unit, while simultaneously providing reheat, is to provide two heat exchange surfaces each in one of the air streams entering or leaving the cooling coil while circulating a working fluid between the two heat exchangers. This type of simple system is commonly called a "run-around" or "wrap-around" system.

These systems have generally met with limited success. The working fluid is cooled in a first heat exchange surface placed in the supply air stream called a reheat coil. The cooled working fluid is then in turn circulated through a second heat exchange surface placed in the return air stream called a precooling coil. This simple closed loop circuit comprises the typical run-around systems available heretofore.

The precooling coil serves to precool the return air flow prior to its entering the air conditioning cooling coil itself. The air conditioning coil then provides more of its cooling capacity for the removal of moisture from the air stream otherwise used for sensible cooling. However, in such systems, the amount of reheat energy available in this process is approximately equal to the amount of precooling accomplished. This is a serious constraint. Additional reheat energy is often needed for injection into the run-around system to maintain the desired dry bulb set point temperature and humidity level in the conditioned space. As described above, supplemental electric reheat has been used with some success.

In addition, the growth of molds in low velocity air conditioning duct systems has recently become a major indoor air quality concern. One of the control measures recognized as having the capability of limiting this undesirable growth is the maintenance of the relative humidity at 70 percent or lower in the air conditioning system air plenums and ducts. Within limits, reheat can be used to precisely control the relative humidity. However, as described above, the amount of reheat energy available in the run-around systems available today may not be sufficient to consistently provide the above level of humidity control, particularly during periods of operation when the air temperature entering the precooling coil is lower than the system design operating temperature.

As a further complication, air conditioning units are also often used for heating purposes as well as for cooling and dehumidification. Electric heating elements are often provided in the air conditioning units to selectively provide the desired amount of heat at precise times of the heating demand. The above demand for heating energy will most often correspond with the demand for heating at other air conditioning units in the locality. This places a substantial and noticeable demand on the electrical power utility system in the community. In many areas, this peak demand has exceeded the capacity of the power system. Many electric utility companies have responded with incentives encouraging their customers to temper their demand during regional peak demand periods. These incentives are often in the form of demand charges which encourage the customer to reduce their demand on the system during those peak times in order to avoid incremental costs in addition to the regular base rates.

It has, therefore, been deemed desirable to provide an economical solution that meets the various needs of air conditioning system installation requirements while also operating in compliance with current and projected local environmental and energy-related laws.

SUMMARY OF THE INVENTION

This invention improves the dehumidification capabilities of conventional air conditioning systems through the addition of a runaround system having a supplemental heat energy source for reheat use. The amount of reheat energy that can be incrementally added to the stream air leaving the conditioning unit is thereby increased. An air conditioning unit so configured is capable of operating continuously over a wide range of conditions for providing dehumidification to the occupied space independent of the sensible cooling demand at the conditioned space. Such a system is further capable of maintaining a precise relative humidity level in the air conditioning duct system to enhance the indoor air quality of the occupied conditioned space. Further, the overall system may be used to heat the occupied space through the expedient of the stored energy scheme according to the teachings of the preferred embodiments.

In the preferred embodiment, the supplemental heat source is heat recovered from the refrigeration process of the particular installed air conditioning system having the reheat requirement. In another embodiment, the supplemental heat is an alternative energy source, such as a gas or electric boiler, or water heater. The new energy source may be of particular benefit for use with an air conditioning system that uses chilled water or cold brine for the cooling medium.

The basic preferred embodiment of the invention comprises heat exchange coils in the entering air stream and leaving air stream of an air conditioning unit primary cooling coil. The basic preferred embodiment further comprises a circulating pump, and a supplementary heat source, which can be a heat recovery device on the air conditioning unit refrigeration circuit or a conventional liquid heater or the like.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
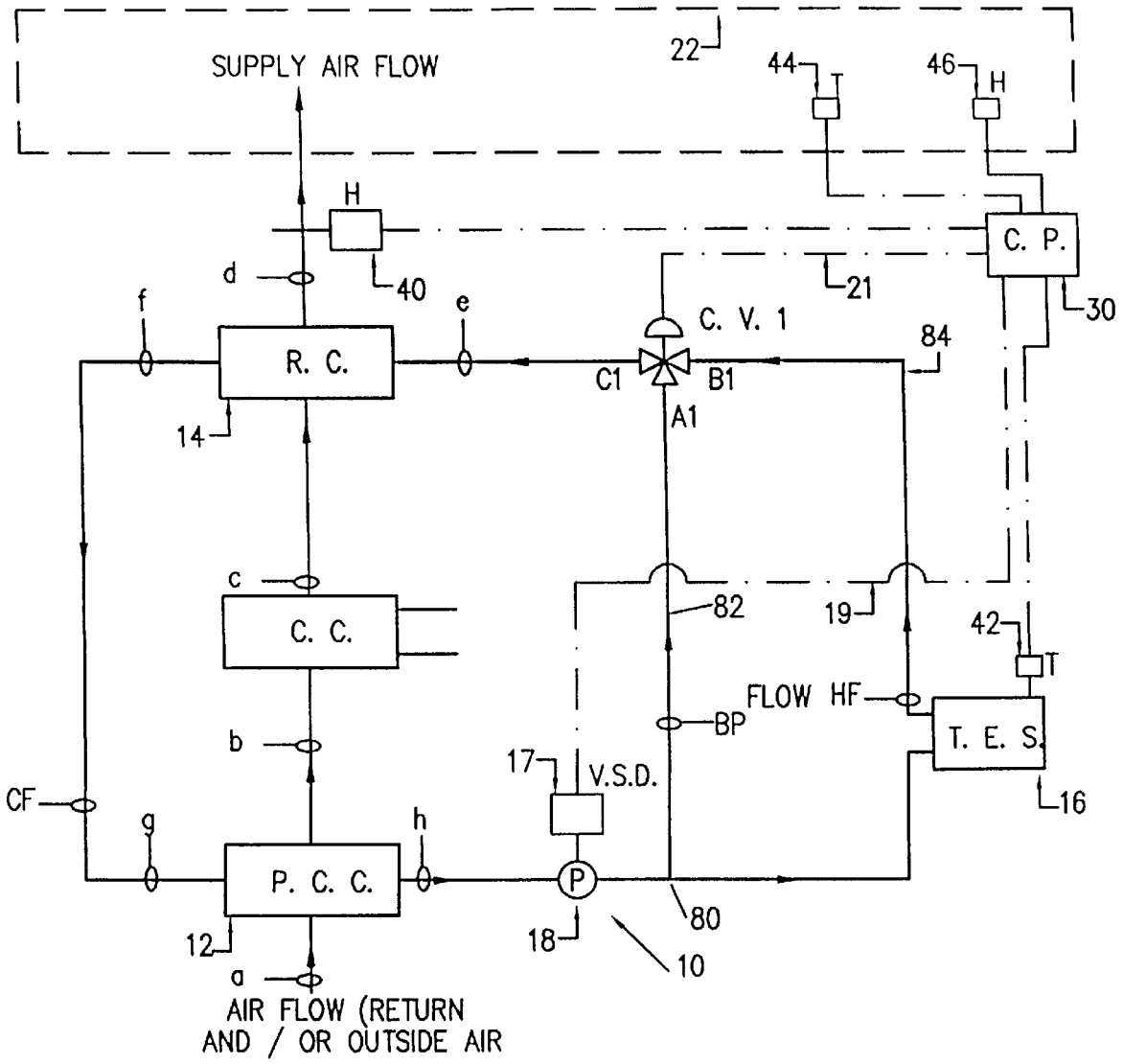
FIG. 1 illustrates a schematic view of a first preferred embodiment of the apparatus for latent heat extraction according to the invention.

Referring now to the drawings wherein showings are for purposes of illustrating the preferred embodiments of the invention only and not for purposes of limiting same, the FIGURES show a moisture control apparatus 10 for conditioning the air in an occupied space 22. The apparatus 10 comprises components suitably arranged for air conditioning and including a precooling coil 12 in a return air flow a,b, a reheat coil 14 in a supply air flow c, d, a thermal energy storage tank 16 operatively associated with a source of heat, a working fluid pump 18 for circulating a working fluid through an arrangement of the above coils and tank, a pump drive 17 for controlling the operation of the fluid pump 18 and a metering control valve CV1 for controlling the mixture of the working fluid routed to the reheat coil 14. An apparatus controller 30 generates a control valve signal for control of the position of the valve CV1. The apparatus controller 30 also generates pump command signals for control over the working fluid pump 18 to effect a working fluid flow at the desired flow rate.

With particular reference first to FIG. 1, the working fluid includes a coil flow CF, a bypass fluid flow BP, and a heated fluid flow HF. The coil flow CF through the reheat and precooling coils 14, 12, exits the control valve CV1 from an exit port C thereof. The control valve CV1 receives the working fluid from a pair of sources including the bypass fluid flow BP entering at port A1 and the heated fluid flow HF entering at port B1. The heated fluid flow HF passes first through the thermal energy storage tank 16 during its flow to the valve CV1. The bypass fluid flow BP, however, bypasses the thermal energy storage tank 16 during its flow to the valve CV1 and is routed from a "T" coupler 80 directly to the control valve CV1 through a bypass conduit 82. The flows of the bypass fluid flow BP and the heated fluid flow HF comprising the working fluid through the coils 12, 14 are motivated by the working fluid pump 18.

Although the working fluid pump 18 is shown as being upstream of said coupler 80, other equivalent positions or locations in the system 10 in this and the other FIGURES are possible such as between the valve CV1 and the reheat coil 14, as an example. A controlled mixture or blending of bypass fluid flow BP and heated fluid flow HF is realized using the control valve 20, which is responsive to the controller 30, to selectively meter the relative proportions of the bypass fluid BP flow (cooler) and the heated fluid HF flow (warmer).

As indicated above, the control valve CV1 includes two input ports A1, B1 and an output port C1. The first input port A1 is connected to the bypass conduit 82 for receiving the bypass fluid flow BP. The second input port B1 is connected to conduit 84 from the thermal energy storage tank 16 for receiving the heated fluid flow HF. The output port C1 is connected to the series arrangement of the reheat coil 14 and the precooling coil 12 for containing and directing the coil fluid flow CF.

In the first preferred embodiment illustrated, the control valve CV1 is a variably adjustable blending valve responsive to an analog signal from the controller 30 for adjusting the relative proportions of the bypass and heated fluid flows over a continuum ranging from total bypass fluid flow to total heated fluid flow and between. As an equivalent alternative to the above valve type, the control valve may be a modulated valve responsive to logical signals from the controller 30. In that alternative case, the duty cycle between ports A1 and B1 being opened and closed controls the blending of the heated and bypass fluid flows HF and BP respectively.

Also in the first preferred embodiment illustrated, the pump drive 17 is responsive to an analog pump speed command signal 19 from the controller 30 to variably control the speed of the working fluid pump 18 over a continuous range. As an alternative to the above, the pump and drive may be of a modulated variety responsive to logical signals from the controller 30. In that alternative case, the duty cycle of the waveform from the controller 30 controls the fluid pressure and in turn volume of the working fluid circulated through the apparatus. Further, the drive may be dispensed with and the pump operated continuously as needed.

With continued reference yet to FIG. 1, the apparatus controller 30 is an operative communication with a plurality of system input devices, each of which sense various physical environmental conditions. These input devices include a supply airflow humidity sensor 40 for sensing the humidity in the supply airflow, a thermal energy storage tank temperature sensor 42 for sensing the temperature in the thermal energy storage tank, an occupied space dry bulb temperature sensor 44 for sensing the dry bulb temperature in the occupied space, and an occupied space humidity sensor 46 for sensing the humidity in the occupied space. The humidity sensor 40 in the supply airflow may be replaced with a temperature sensor for ease of maintenance and reliability or, a combination of a temperature sensor and humidity sensor may be used.

The controller 30 is also in operative communication with a plurality of active output devices. The output devices are responsive to signals deriving from the apparatus controller 30 according to programmed control procedures detailed below. In the preferred embodiment, the output devices comprise the control valve CV1 responsive to the control valve signal 21, and the variable speed drive 17 responsive to the pump speed command signal 19. Additional input and output signals, including alarm and data logging signals or the like, may be added to the basic system illustrated in FIG. 1 as understood by one skilled in the art after reading and understanding the instant detailed description of the preferred embodiments.

Figure 2:
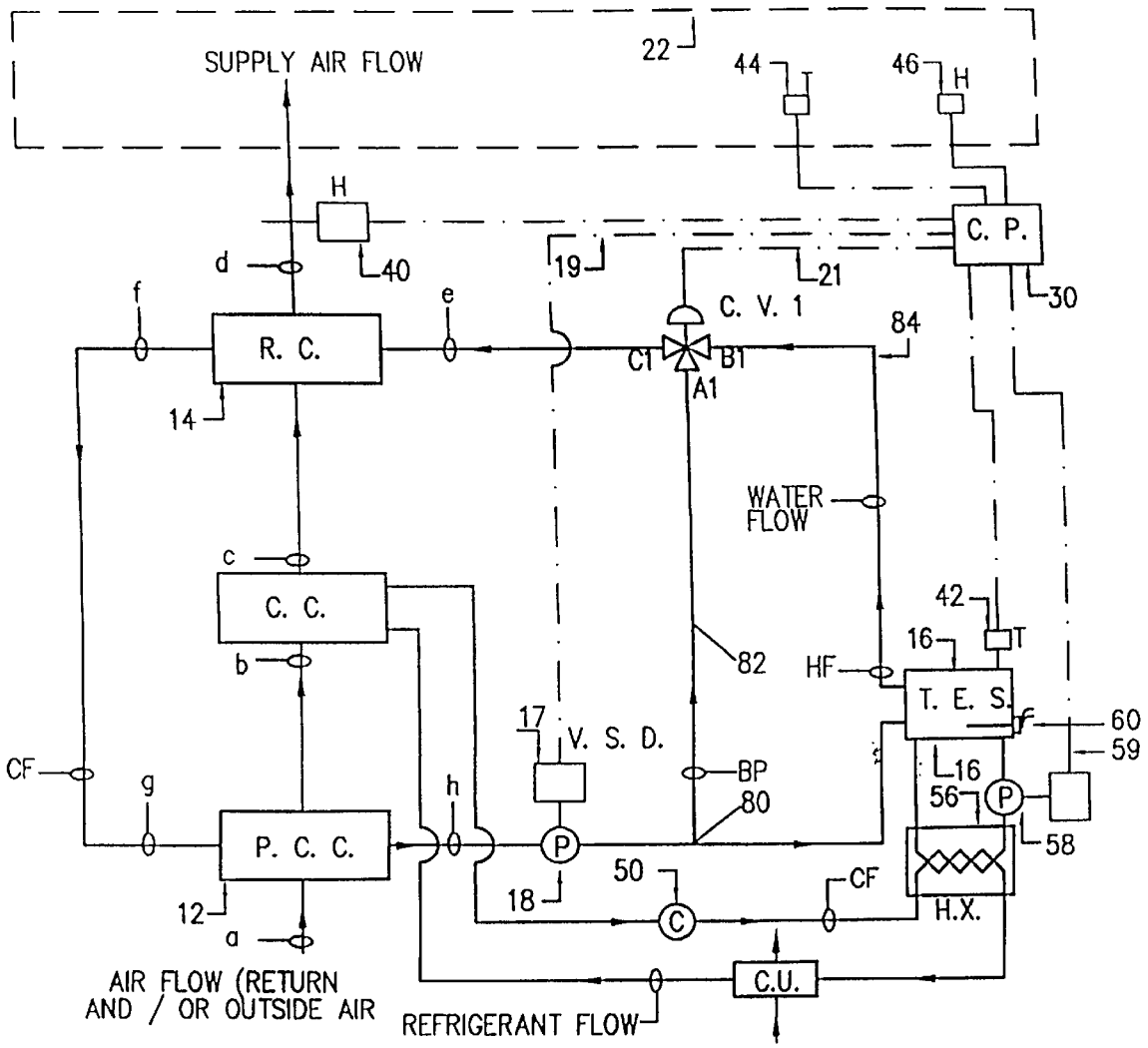
FIG. 2 illustrates a schematic view of the first preferred embodiment of the invention when used with a conventional air conditioning unit having a vapor compression type refrigeration system.

With particular reference now to FIG. 2, a schematic diagram of the first preferred embodiment of the apparatus of the invention is illustrated adapted for use with a conventional air conditioning unit having a vapor compression type refrigeration system. The system includes a compressor 50 for compressing a compressible fluid CF and a condenser coil 52. An evaporative cooling coil 54 absorbs heat from the return air flow a, b resulting in a cooled supply air flow c,d into the occupied space 22. These various air conditioning components may be assembled in a single package, known in the art as a "roof-top" unit, or may be provided as a system comprising separated items, such as what is commonly called a "split system".

With continued reference to FIG. 2, the reheat coil 14, as described above, is placed in the supply air flow c, d after (downstream of) the evaporative cooling coil 54, while the precooling coil 12 is placed in the return air flow a, b before (upstream of) the cooling coil 54. For full effectiveness of the air quality control measure of the instant invention, the reheat coil 14 should be physically mounted as close as possible to the cooling coil 54. The precooking coil 12 can be mounted in any convenient location and may be so situated as to precool only the outside air, only the return air, or a mixture of the outside air and return air. Thus, although not shown in the FIGURES, the invention is suited for use in 100% outside air systems wherein the return air flow is exclusively outside air, as well as in systems wherein the return air flow comprises a blend of air from the occupied space and the outside air. For ease of discussion here, the expression "return air" will be used and includes any return air from whatever source.

As discussed above in connection with FIG. 1, the working fluid pump 18 is connected to a variable speed drive 17 which operates to circulate the working fluid WF between the reheat coil 14, the precooling coil 12, and the thermal energy storage tank 16. In general, the overall system is used in various operating modes including a space cooling mode, a space dehumidification mode, and a space heating mode. To describe the full operation of the system, each of the operational modes will be described in detail below.

In the space cooling mode, the working fluid pump 18 operates when the refrigeration system compressor 50 is operating. In this mode, the compressor 50 is responsive to the occupied space dry bulb temperature sensor 44. The pump 18 is driven by the variable speed drive 17 which regulates the water flow to maintain the desired humidity setting at the supply air flow humidity sensor 40. Water flow (working fluid WF flow) is increased on a rise in the relative humidity above a predetermined set point and conversely, decreased on a drop in relative humidity at the supply air flow humidity sensor 40 below said set point.

In the space dehumidification mode, the compressor 50 of the conventional air conditioning unit is operated to maintain the humidity in the occupied space 22, as sensed by the occupied space humidity sensor 46. The speed or duty cycle of the working fluid pump 18 is regulated to maintain the desired temperature of the occupied space 22 as sensed by the occupied space dry bulb temperature sensor 44. In this dehumidification mode of operation, working fluid flow WF is increased on a drop in temperature at the occupied space dry bulb temperature sensor 44, and water flow is conversely decreased on a rise in the occupied space temperature responsive to command signals from the apparatus controller 30 and according to the control algorithms described in detail below. When the temperature in the occupied space is a controlling factor in setting the working fluid pump speed, the supply air flow humidity set point is used to establish a minimum working fluid pump speed or duty cycle. In any of the above modes, alternative working fluid flow control may be accomplished using a two-port valve with a modulating actuator in place of the variable speed drive 17 or duty cycle actuation technique.

In general terms, cooled air leaving the evaporative type cooling coil 54 enters the reheat coil 14 where it absorbs heat from the working fluid flow in the tubes of the reheat coil itself. A drop in heat content of the working fluid occurs from points e to f. The amount of the heat content drop is roughly equal to the amount of rise in heat content of the air stream from points c to d. The working fluid is transferred through the piping conduit system 32 to the precooling coil 12.

Cooled working fluid from the reheat coil 14 absorbs heat from the return air flow stream as the air passes over the precooling coil surfaces. There is a rise in the heat content in the working fluid from points g to h roughly equal to the drop in the heat content of the air stream from points a to b. These principles are each generally well known and established in the art.

In the preferred embodiment shown in FIG. 2, a heat exchange pump 58 operates whenever the compressor 50 is operating and whenever the temperature and the thermal energy storage tank 16 is below a predetermined set point as determined by the thermal energy storage tank temperature sensor 42. The general function of the heat exchanger 56 is to provide supplemental heat to charge the thermal energy storage tank 16 with hot working fluid for heating and/or reheat operation. The heat exchange pump 58 transfers working fluid WF from the thermal energy storage tank 16 to the heat exchanger 56 where it is heated by the hot refrigerant from the compressor 50. According to the preferred operational safety algorithm of the system, the heat exchange pump 58 ceases pumping whenever the temperature in the thermal energy storage tank 16 is at an upper working fluid temperature set point as determined by the thermal energy storage tank temperature sensor 42 even though the compressor 50 may be running. This function is to prevent over heating in the thermal energy storage tank.

An electric heating element 60 may be used as an additional energy source to heat the working fluid when there is a demand for heat energy beyond that which may be provided in the heat exchanger 56. The supplemental electric heating operation is controlled by the apparatus controller 30 to operate as a secondary source of energy when the temperature in the thermal energy storage tank 16 drops below the desired set point as determined by the thermal energy storage tank temperature sensor 42. As an example, if the desired minimum temperature in the thermal energy storage tank is 120° F. and the desired maximum temperature is 125° F., the heat exchange pump 58 is controlled to begin operation (pump) on a drop in temperature below 120° F. Conversely, when the thermal energy storage tank temperature drops to 120° F., the electric heating element 60 is activated by the apparatus controller 30. On a rise in the thermal energy storage tank temperature, the heating element 60 is first turned off, and on a continued rise in temperature to the 125° F. set point, the heat exchange pump 58 is next turned off. This scheme is arranged hierarchically in order to best conserve energy by first recovering waste energy from the air conditioning unit which is normally otherwise lost.

Multiple heating elements similar to the electric heating element shown may be provided and controlled by a step controller to match the energy to the heating load in stages of electric heat.

An SCR controller may be used to proportionally control the amount of heat energy added to the thermal energy storage tank 16 as a function of the tank temperature differential from minimum to maximum set points. On a larger scale, such as a neighborhood-wide system, the electric heating controls may be circuited to allow the lock-out of the electric heating elements during periods of peak electrical demand throughout the neighborhood. This lock-out control may be in the form of an external signal, such as those currently provided by electric utilities, or from the home or business owner's energy management system. The control may further be obtained from a signal from the system controls contained in the apparatus controller 30, as a function of the time of day, demand limiting, or other energy management strategies.

Figure 3:
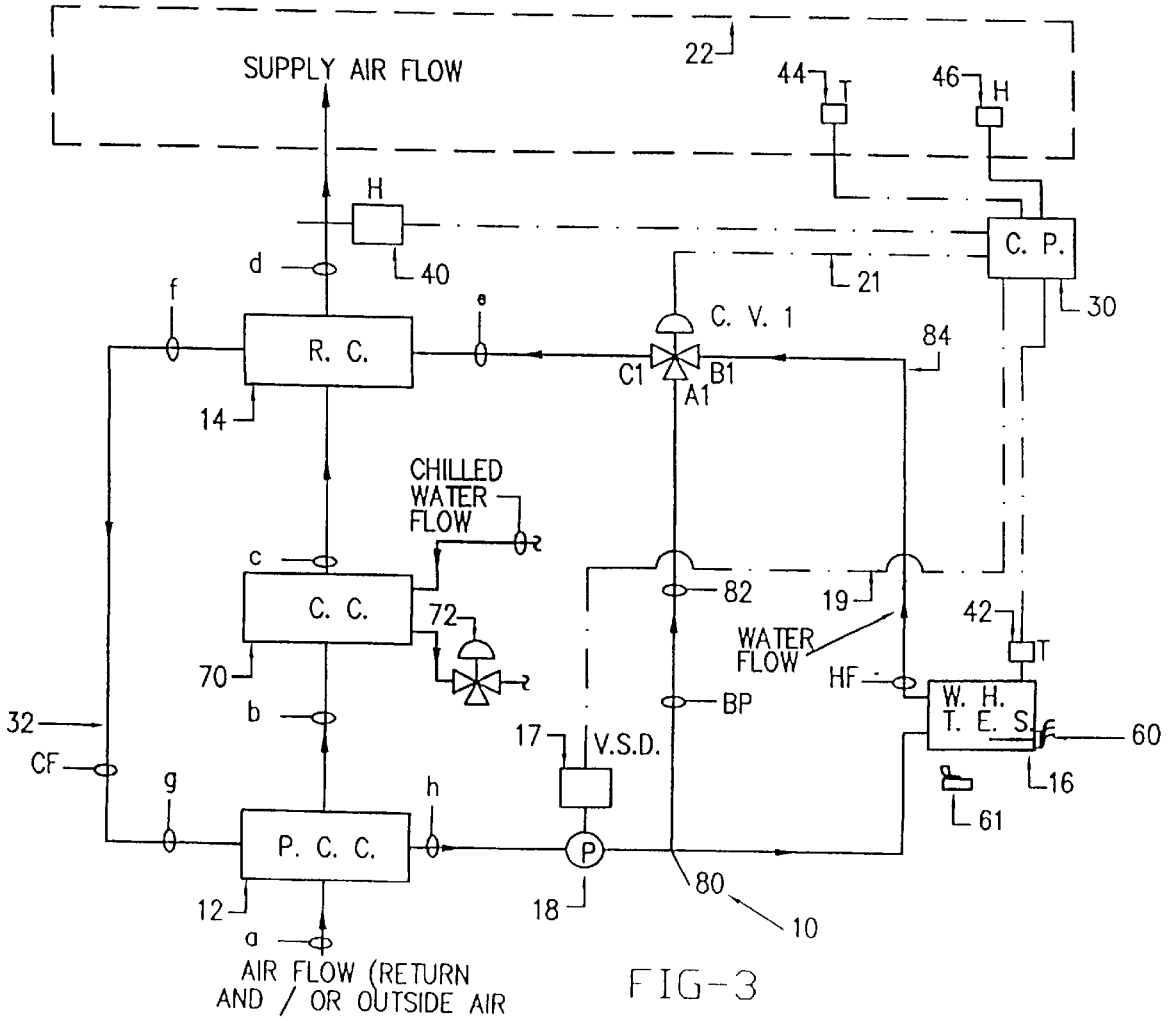
FIG. 3 illustrates a schematic of the first preferred embodiment of the invention when used with an air conditioning unit using chilled water for the cooling medium.

Referring next to FIG. 3, a schematic diagram of the first preferred embodiment of the invention is illustrated and modified for use with an air-conditioning unit using chilled water as the cooling medium. The chilled water system uses a chilled water cooling coil 70 which may be mounted in a duct or plenum, or can be mounted in an air-handling unit with integral or remotely mounted fans. Chilled water systems are usually provided with a control valve 72 to regulate the amount of cooling accomplished by the system in response to the occupied space dry bulb temperature sensor 44. In the system illustrated, the coolant in the chilled water system is different than and maintained separated from, the working fluid WF.

With continued reference to FIG. 3, a reheat coil 14, as described above, is placed in the supply air flow c, d after (downstream of) the evaporative cooling coil 54, while a precooling coil 12 is placed in the return air flow a, b before (upstream of) the cooling coil 70. As was true for use with the evaporative system described above, for full effectiveness of the air quality control measure of the instant invention the reheat coil 14 should be mounted as close as possible to the cooling coil 70. The precooling coil 12 can be mounted in any convenient location and may be so situated as to precool only the outside air, only the return air from the occupied space 22, or a mixture of the outside air and return air from the space 22.

The pump 18 is connected to a variable speed drive 17 which operates to circulate the working fluid WF, preferably water, between the reheat coil 14, the precooling coil 12, and the thermal energy storage tank 16. In general, as with the embodiment used in combination with the evaporative air conditioning system, the first preferred embodiment is useful with chilled water systems in various operating modes including a space cooling mode, a space dehumidification mode, and a space heating mode. A pair of specialized operating modes particularly useful in combination with chilled water systems in cold climates will be described below in connection with second and third preferred embodiments of the present invention. First, however, each of the cooling, dehumidification, and heating operational modes will be described.

In the space cooling mode, the working fluid pump 18 operates when there is a demand for cooling in space 22. In this mode, the control valve 72 is responsive to the occupied space dry bulb temperature sensor 44. The pump 18 is driven by the variable speed drive 17 which regulates the working water flow to maintain the desired humidity setting at the supply air flow humidity sensor 40. Water flow (working fluid flow WF) is increased on a rise in the relative humidity above a predetermined set point and conversely, decreased on a drop in relative humidity at the supply air flow humidity sensor 40 below said set point.

In the space dehumidification mode, the chilled water air conditioning unit is operated to maintain the humidity at the occupied space 22, as sensed by the occupied space humidity sensor 46. The speed of the working fluid pump 18 is regulated to maintain the desired temperature of the occupied space 22 as sensed by the occupied space dry bulb temperature sensor 44. In this dehumidification mode of operation, working fluid flow WF is increased on a drop in temperature at the occupied space dry bulb temperature sensor 44, and water flow is conversely decreased on a rise in the occupied space temperature responsive to command signals from the apparatus controller 30 and according to the control algorithms detailed below. When the temperature in the occupied space is a controlling factor in setting the working fluid pump speed, the supply air flow humidity set point is used to establish a minimum working fluid pump speed or duty cycle. In any of the above modes, alternative working fluid flow control may be accomplished using a two-port valve with a modulating actuator in place of the variable speed drive 17 or duty cycle actuation technique.

In general terms, cooled air leaving the chilled water type cooling coil 70 enters the reheat coil 14 where it absorbs heat from the working fluid flow in the tubes of the reheat coil itself. A drop in heat content of the working fluid occurs from points e to f. The amount of heat content drop is roughly equal to the amount of rise in heat content of the air stream realized from points c to d. The working fluid is transferred through the piping conduit system 32 directly to the precooling coil 12.

Cooled working fluid from the reheat coil 14 absorbs heat from the return air flow stream as it passes over the precooling coil surfaces. There is a rise in the heat content in the working fluid from points g to h approximately equal to the drop in the heat content of the air stream from points a to b. These principles are generally well-known and established in the art.

An electric heating element 60 or a gas heating element 61 may be used as a supplemental energy source to heat the working fluid in the storage tank when there is a demand for additional heat. The supplemental electric and/or gas heating operations are controlled by the apparatus controller 30 to operate as a secondary source of energy when the temperature in the thermal energy storage tank 16 drops below the desired set point as determined by the thermal energy storage tank temperature sensor 42. As an example, if the desired minimum temperature in the thermal energy storage tank is 120° F. and the desired maximum temperature is 125° F., at least one or both of the electric heating element 60 and the gas heating element 61 is/are activated by the apparatus controller 30 when the thermal energy storage tank temperature drops to 120° F. On a return in the thermal energy storage tank temperature to 125° F., power to the heating element and/or gas to the burner, is turned off. Multiple heating elements similar to the electric and gas heating elements described above may be provided and controlled by a step controller to match the energy input to the heating load in stages of electric or gas heat. An SCR controller may be used to proportionally control the amount of heat energy added to the thermal energy storage tank 16 as a function of the tank temperature differential from minimum to maximum set points. On a larger scale, such as a neighborhood-wide system, the electric heating controls may be circuited to allow for the lock-out of the electric heating elements during periods of peak electrical demand throughout the neighborhood. This lock-out control may be in the form of an external signal, such as those currently provided by electric utilities, or from the home or business owner's energy management system. The control may further be obtained from a signal from the system controls contained in the apparatus controller 30, as a function of the time of day, demand limiting, or other energy management strategies.

Figure 4:
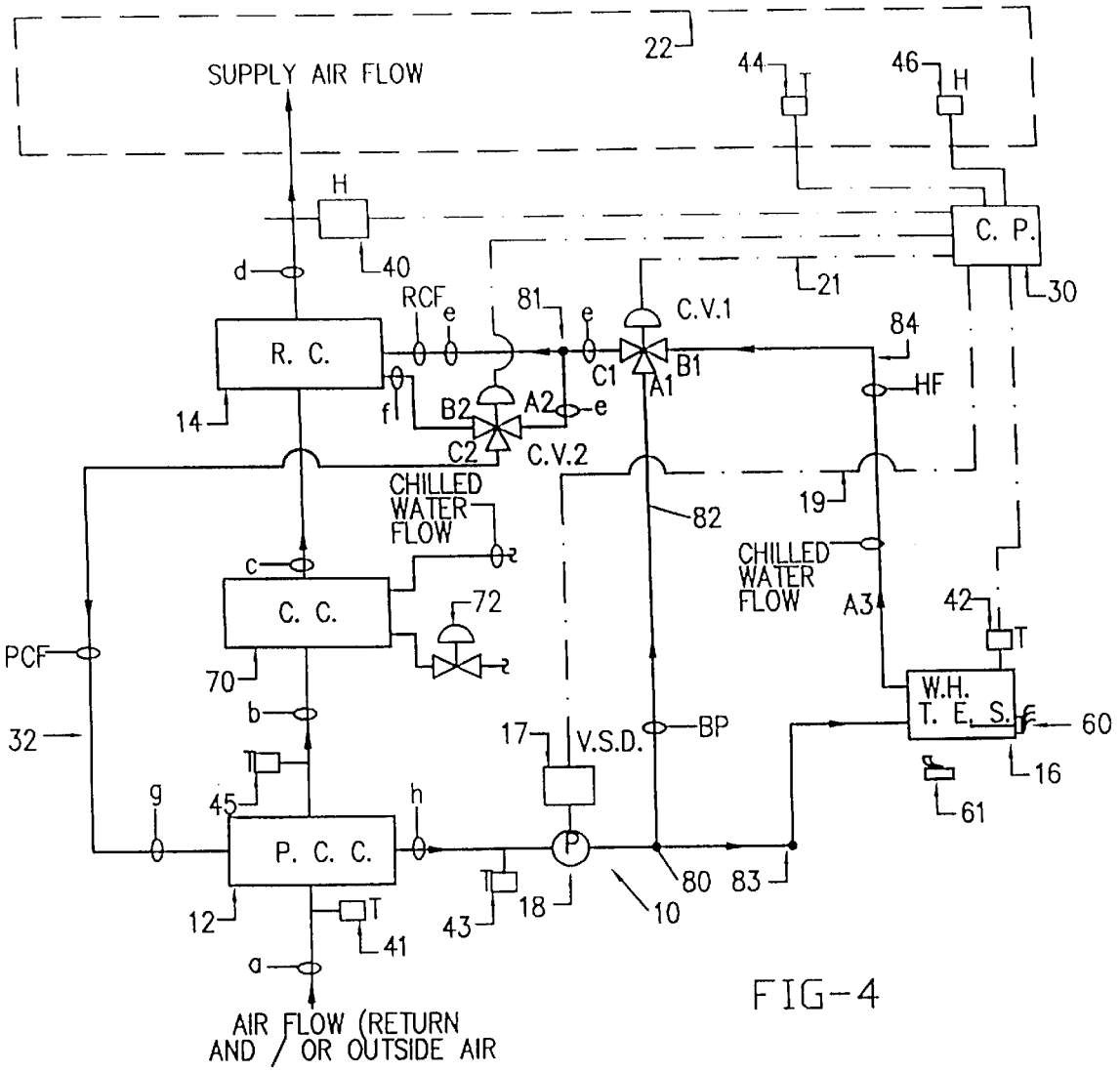
FIG. 4 illustrates a schematic of the second preferred embodiment of the invention when used with an air conditioning unit using chilled water for the cooling medium.

With reference now to FIG. 4, a second preferred embodiment of the invention will be described in combination with a chilled water type air conditioning system such as shown in FIG. 3. The FIGURE shows a moisture control apparatus 10 especially well suited for conditioning the air in the occupied space 22 and for preventing freezing in the chilled water cooling coil 70 when using 100% outside return air in colder climates. The apparatus 10 comprises components suitably arranged for air conditioning and including a precooling coil 12 in the return air flow a, b, a reheat coil 14 in the supply air flow c, d, a thermal energy storage tank 16 operatively associated with a source of heat, a working fluid pump 18 for circulating the working fluid WF through an arrangement of the above coils and tank, a pump drive 17 for controlling the operation of the fluid pump 18 and a pair of metering control valves CV1, CV2 for controlling the mixture of the working fluid WF routed to the reheat coil 14. The apparatus controller 30 generates control valve signals for control of the positions of the valves CV1, CV2. The apparatus controller 30 also generates pump command signals for control over the working fluid pump 18 to effect a working fluid flow at the desired flow rate.

The working fluid includes a reheat coil flow RCF, a precooling coil flow PCF, a bypass fluid flow BP, and a heated fluid flow HF. The reheat coil flow RCF through the reheat coil 14 exits the first control valve CV1 through an exit port C1 thereof and flows directly to the reheat coil without flowing through the second control valve CV2. The precooling coil flow PCF through the precooling coil 12 exits the second control valve CV2 from an exit port C2 thereof after being routed around the reheat coil, effectively bypassing the reheat coil.

The first control valve CV1 receives the working fluid WF from a pair of sources including the bypass fluid flow BP entering at port A1 and the heated fluid flow HF entering at port B1. The heated fluid flow HF passes first through the thermal energy storage tank 16 during its flow to the valve CV1. The bypass fluid flow BP, however, bypasses the thermal energy storage tank 16 during its flow to the valve CV1 and is routed from a "T" coupler 80 directly to the control valve CV1 through a bypass conduit 82. The flows of the bypass fluid flow BP and the heated fluid flow HF comprising the working fluid through the coils 12 and/or 14 are motivated by the working fluid pump 18. Although the working fluid pump 18 is shown as being upstream of said coupler 80, other equivalent positions or locations in the system 10 in this and the other FIGURES are possible such as between the first control valve CV1 and the second control valve CV2.

The second control valve CV2 receives the working fluid WF from a pair of sources including a reheat coil bypass fluid flow e" entering the second control valve CV2 at port A2 from the output port C1 of the first control valve CV1. A reheat coil fluid flow e' exits the first control valve and passes through the reheat coil 14 before entering the second input port B2 of the valve CV2. The reheat bypass fluid flow e" bypasses the reheat coil 14 during its flow from the valve CV1 and is routed from a "T" coupler 81 directly to the control valve CV2 through a bypass conduit as shown.

A controlled mixture or blending of bypass fluid flow BP and heated fluid flow HF is realized using the first control valve CV1, which is responsive to the controller 30, to selectively meter the relative proportions of the bypass fluid BP flow (cooler) and the heated fluid HF flow (warmer). Similarly, a controlled mixture or blending of the reheat coil bypass fluid flow e" and heated fluid flow HF to the reheat coil e' is realized using the second control valve CV2, which is also responsive to the controller 30, to selectively meter the relative proportions of the bypass fluid e" flow and the reheat coil fluid flow e'.

As indicated above, the control valve CV1 includes two input ports A1, B1 and an output port C1. The first input port A1 is connected to the bypass conduit 82 for receiving the bypass fluid flow BP. The second input port B1 is connected to conduit 84 from the thermal energy storage tank 16 for receiving the heated fluid flow HF. The output port C1 is connected to a second "T" connector 81 which divides the working fluid flow e into the reheat coil flow e' and the reheat coil bypass flow e" based on the position of setting of the second control valve CV2. The second control valve CV2 includes two input ports A2, B2 and an output port C2. The first input port A2 is connected to a conduit for receiving the reheat bypass fluid flow e" from the first valve CV1 through the "T" connector 81. The second input port B2 is connected to a conduit as shown for receiving the portion of the working fluid flowing through the reheat coil. The output port C2 is connected to a conduit 32 for directing the working fluid to the precooling coil 12 as a precooling coil fluid flow PCF.

In the embodiment illustrated, each of the control valve CV1, CV2 are independently variably adjustable blending valves responsive to separate analog signals from the controller 30 for adjusting the relative proportions of the fluid flows into their input ports over a continuum ranging from total flow through port A to total flow through port B and between. As an equivalent alternative to the above valve types, the control valves may be modulated valves responsive to logical signals from the controller 30. In that alternative case, the duty cycle between ports A and B being opened and closed controls the blending of the fluid flows A and B respectively.

Also in the embodiment illustrated, the pump drive 17 is responsive to an analog pump speed command signal 19 from the controller 30 to variably control the speed of the working fluid pump 18 over a continuous range. As an alternative to the above, the pump and drive may be of a modulated variety responsive to logical signals from the controller 30. In that alternative case, the duty cycle of the waveform from the controller 30 controls the fluid pressure and in turn volume of the working fluid circulated through the apparatus. Further, the drive may be dispensed with and the pump operated continuously as needed.

With continued reference to FIG. 4, the apparatus controller 30 is an operative communication with a plurality of system input devices, each of which sense various physical environmental conditions. These input devices include a supply airflow humidity sensor 40 for sensing the humidity in the supply airflow, a return air flow temperature sensor 41 for sensing the dry bulb temperature in the return airflow a upstream of the precooling coil, a thermal energy storage tank temperature sensor 42 for sensing the temperature in the thermal energy storage tank, a precooling coil fluid temperature sensor 43 for sensing the temperature of the fluid h exiting the precooling coil, an occupied space dry bulb temperature sensor 44 for sensing the dry bulb temperature in the occupied space, a return air flow temperature sensor 45 for sensing the dry bulb temperature in the return airflow b downstream of the precooling coil, and an occupied space humidity sensor 46 for sensing the humidity in the occupied space.

The controller 30 is also in operative communication with a plurality of active output devices. The output devices are responsive to signals deriving from the apparatus controller 30 according to programmed control procedures detailed below. In this preferred embodiment, the output devices comprise the control valves CV1, CV2 responsive to the control valve signals 21, 21' and the variable speed drive 17 responsive to the pump speed command signal 19.

In the space cooling, space dehumidification and space heating modes, the system 10 operates as described above. More particularly, the controller operates the first control valve CV1 to appropriately blend the fluid flows through ports A1 and B1 thereof. During these modes, the controller commands the second control valve to operate in a single position wherein all of the flow through the valve is into port B2 and out of port C2. The following table describes the positioning of the valves CV1, CV2 in the various modes of operation:

100% wrap around coil mode

CV1 A1 open, B1 closed

CV2 A2 closed, B2 opened space cooling mode

CV1 A1, B1 mixed to maintain humidity setpoint at sensor 40

CV2 A2 closed, B2 opened space dehumidification mode

CV1 A1, B1 mixed to maintain temp setpoint at sensor 44

CV2 A2 closed, B2 opened space heating mode

CV1 A1, B1 mixed to maintain temp setpoint at sensor 44

CV2 A2 closed, B2 opened

In order to prevent freezing in the chilled water cooling coil during periods of extreme temperature drop while operating in the space heating mode, the second control valve CV2 is actuated by the controller 30 responsive to a return air flow temperature signal from the sensor 41 in the return air flow. In this freeze prevention mode, it is desirable to warm the return air flow b entering the cooling coil. When the return air flow temperature sensor realizes a temperature of about 40 F., the controller operates the valves in the freeze prevention mode according to:

freeze prevention mode

CV1 A1 closed, B1 opened

CV2 A2 opened, B2 closed

Figure 5:
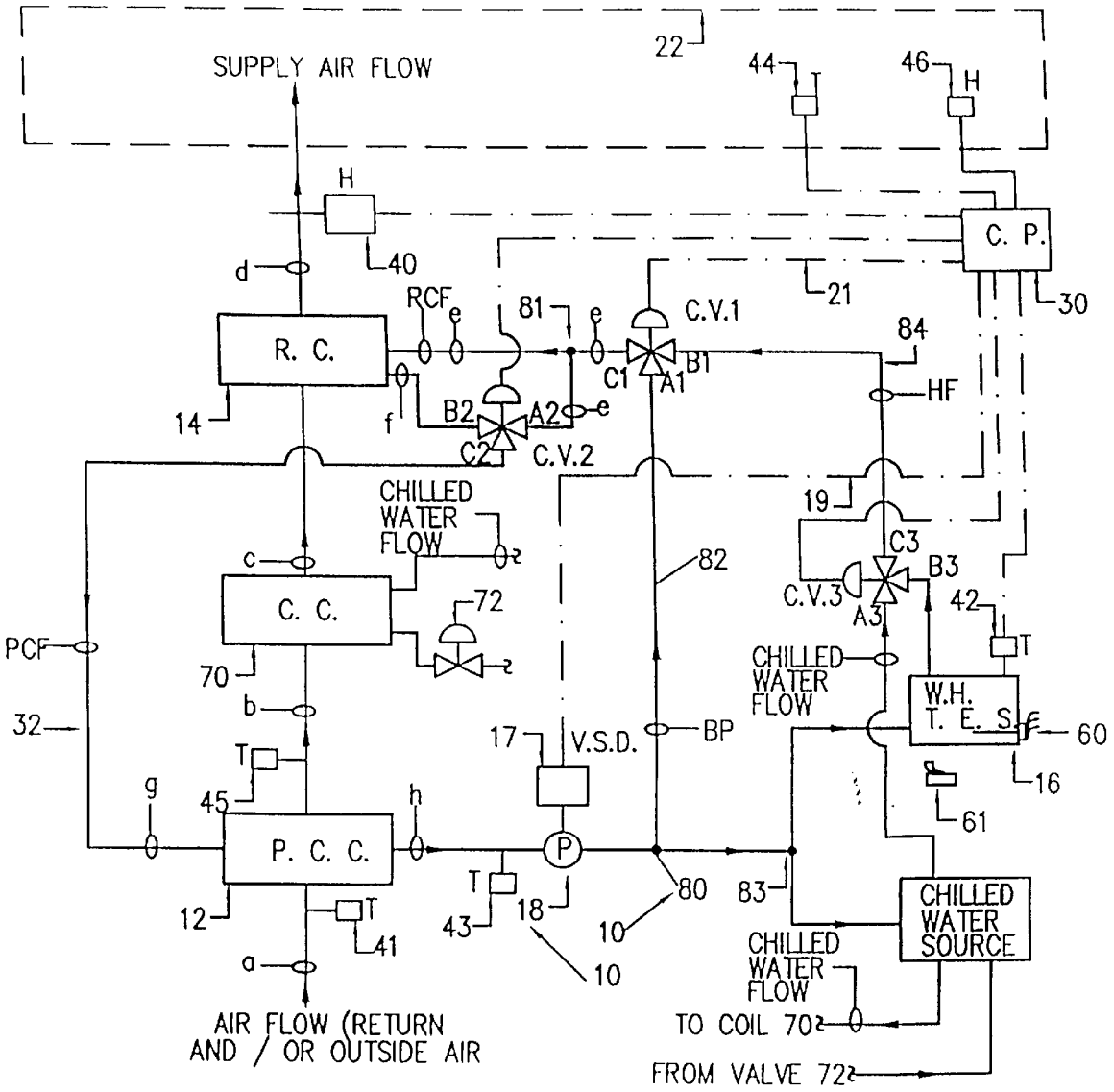
FIG. 5 illustrates a schematic of the third preferred embodiment of the invention when used with an air conditioning unit using chilled water for the cooling medium.

With reference now to FIG. 5, a third preferred embodiment of the invention will be described in combination with a chilled water type air conditioning system such as shown in FIGS. 3 and 4. The FIGURE shows a moisture control apparatus 10 especially well suited for conditioning the air in the occupied space 22 and for preventing freezing in the chilled water cooling coil 70 when using 100% outside return air in colder climates. Freezing is prevented using energy from either a heated water source or from the chilled water of the air conditioning system. The apparatus 10 comprises components suitably arranged for air conditioning and including a precooling coil 12 in the return air flow a, b, a reheat coil 14 in the supply air flow c, d, a thermal energy storage tank 16 operatively associated with a source of heat, a working fluid pump 18 for circulating the working fluid WF through an arrangement of the above coils and tank, a pump drive 17 for controlling the operation of the fluid pump 18 and a set of metering control valves CV1, CV2, CV3 for controlling the mixture of the working fluid WF routed through the system 10. The apparatus controller 30 generates control valve signals for control of the positions of the valves CV1, CV2, CV3. The apparatus controller 30 also generates pump command signals for control over the working fluid pump 18 to effect a working fluid flow at the desired flow rate.

The working fluid includes a reheat coil flow RCF, a precooling coil flow PCF, a bypass fluid flow BP, a heated fluid flow HF, a hot water source HWF and a chilled water source CWF. The reheat coil flow RCF through the reheat coil 14 exits the first control valve CV1 through an exit port C1 thereof and flows directly to the reheat coil without flowing through the second control valve CV2. The precooling coil flow PCF through the precooling coil 12 exits the second control valve CV2 from an exit port C2 thereof after being routed around the reheat coil, effectively bypassing the reheat coil. The hot water source flow HWF enters input port B3 of valve CV3 and the chilled water flow CWF enters port B3 of the valve CV3. The hot water source flow HWF and the chilled water flow CWF are mixed by the valve CV3 to form the heated fluid flow HF.

The first control valve CV1 receives the working fluid WF from a pair of sources including the bypass fluid flow BP entering at port A1 and the heated fluid flow HF entering at port B1. The heated fluid flow HF passes first through the thermal energy storage tank 16 during its flow to the valve CV1. The bypass fluid flow BP, however, bypasses the thermal energy storage tank 16 during its flow to the valve CV1 and is routed from a "T" coupler 80 directly to the control valve CV1 through a bypass conduit 82. The flows of the bypass fluid flow BP and the heated fluid flow HF comprising the working fluid through the coils 12 and/or 14 are motivated by the working fluid pump 18. Although the working fluid pump 18 is shown as being upstream of said coupler 80, other equivalent positions or locations in the system 10 in this and the other FIGURES are possible such as between the first control valve CV1 and the second control valve CV2.

The second control valve CV2 receives the working fluid WF from a pair of sources including a reheat coil bypass fluid flow e" entering the second control valve CV2 at port A2 from the output port C1 of the first control valve CV1. A reheat coil fluid flow e' exits the first control valve and passes through the reheat coil 14 before entering the second input port B2 of the valve CV2. The reheat bypass fluid flow e" bypasses the reheat coil 14 during its flow from the valve CV1 and is routed from a "T" coupler 81 directly to the control valve CV2 through a bypass conduit as shown.

The third control valve CV3 receives the working fluid WF from a pair of sources including the heated water flow HWF from the thermal energy storage tank 16 and the chilled water flow CWF from the chilled water source 23 of the chilled water air conditioning system. The "T" connector 83 downstream of the pump 18 directs the portion of the working fluid flow not routed as bypass flow BP by the "T" connector 80 to either the tank 16 or the chilled water source 23 based on the position of the third valve CV3.

A controlled mixture or blending of bypass fluid flow BP and heated fluid flow HF is realized using the first control valve CV1, which is responsive to the controller 30, to selectively meter the relative proportions of the bypass fluid BP flow (cooler) and the heated fluid HF flow (warmer). Similarly, a controlled mixture or blending of the reheat coil bypass fluid flow e" and heated fluid flow HF to the reheat coil e' is realized using the second control valve CV2, which is also responsive to the controller 30, to selectively meter the relative proportions of the bypass fluid e" flow and the reheat coil fluid flow e'. Lastly, a controlled mixture or blending of the heated water flow HWF and the chilled water flow CWF is accomplished using the third control valve CV3, which is also responsive to the controller 30, to selectively meter the relative proportions of the fluid flows HWF, CWF forming the heated fluid HF flow.

As indicated above, the control valve CV1 includes two input ports A1, B1 and an output port C1. The first input port A1 is connected to the bypass conduit 82 for receiving the bypass fluid flow BP. The second input port B1 is connected to conduit 84 from the thermal energy storage tank 16 for receiving the heated fluid flow HF. The output port C1 is connected to a second "T" connector 81 which divides the working fluid flow e into the reheat coil flow e' and the reheat coil bypass flow e" based on the position of setting of the second control valve CV2. The second control valve CV2 includes two input ports A2, B2 and an output port C2. The first input port A2 is connected to a conduit for receiving the reheat bypass fluid flow e" from the first valve CV1 through the "T" connector 81. The second input port B2 is connected to a conduit as shown for receiving the portion of the working fluid flowing through the reheat coil. The output port C2 is connected to a conduit 32 for directing the working fluid to the precooling coil 12 as a precooling coil fluid flow PCF. The third control valve CV3 includes two input ports A3, B3 and an output port C3. The first input port A3 is connected to a conduit for receiving the chilled water fluid flow CWF from the first chilled water source 23. The second input port B3 is connected to a conduit as shown for receiving the heated water fluid flow HWF from the thermal energy storage tank 16. The output port C3 is connected to a conduit 84 for directing the heated fluid HF flow to the second input port B1 of the first control valve CV1.

In the embodiment illustrated, each of the control valves CV1, CV2, CV3 are independently variably adjustable blending valves responsive to separate analog signals from the controller 30 for adjusting the relative proportions of the fluid flows into their input ports over a continuum ranging from total flow through port A to total flow through port B and between. As an equivalent alternative to the above valve types, the control valves may be modulated valves responsive to logical signals from the controller 30. In that alternative case, the duty cycle between ports A and B being opened and closed controls the blending of the fluid flows A and B respectively.

Also in the embodiment illustrated, the pump drive 17 is responsive to an analog pump speed command signal 19 from the controller 30 to variably control the speed of the working fluid pump 18 over a continuous range. As an alternative to the above, the pump and drive may be of a modulated variety responsive to logical signals from the controller 30. In that alternative case, the duty cycle of the waveform from the controller 30 controls the fluid pressure and in turn volume of the working fluid circulated through the apparatus. Further, the drive may be dispensed with and the pump operated continuously as needed.

With continued reference to FIG. 5, the apparatus controller 30 is an operative communication with a plurality of system input devices, each of which sense various physical environmental conditions. These input devices include a supply airflow humidity sensor 40 for sensing the humidity in the supply airflow, a return air flow temperature sensor 41 for sensing the dry bulb temperature in the return airflow a upstream of the precooling coil, a thermal energy storage tank temperature sensor 42 for sensing the temperature in the thermal energy storage tank, a precooling coil fluid temperature sensor 43 for sensing the temperature of the fluid h exiting the precooling coil, an occupied space dry bulb temperature sensor 44 for sensing the dry bulb temperature in the occupied space, a return air flow temperature sensor 45 for sensing the dry bulb temperature in the return airflow b downstream of the precooling coil, and an occupied space humidity sensor 46 for sensing the humidity in the occupied space.

The controller 30 is also in operative communication with a plurality of active output devices. The output devices are responsive to signals deriving from the apparatus controller 30 according to programmed control procedures detailed below. In this preferred embodiment, the output devices comprise the control valves CV1, CV2, CV3 responsive to the control valve signals 21,21', 21" and the variable speed drive 17 responsive to the pump speed command signal 19.

In the space cooling, space dehumidification and space heating modes, the system 10 operates as described above. More particularly, the controller operates the first control valve CV1 to appropriately blend the fluid flows through ports A1 and B1 thereof. During these modes, the controller commands the second and third control valves CV2, CV3 to operate in a single position wherein all of the flow through the valves are into ports B2, B3 and out of ports C2, C3 respectively. The following table describes the positioning of the valves CV1, CV2, CV3 in the various modes of operation:

100% wrap around coil mode

CV1 A1 open, B1 closed

CV2 A2 closed, B2 opened

CV3 A3 closed, B3 opened space cooling mode

CV1 A1, B1 mixed to maintain humidity setpoint at sensor 40

CV2 A2 closed, B2 opened

CV3 A3 closed, B3 opened space dehumidification mode

CV1 A1, B1 mixed to maintain temp setpoint at sensor 44

CV2 A2 closed, B2 opened

CV3 A3 closed, B3 opened space heating mode

CV1 A1, B1 mixed to maintain temp setpoint at sensor 44

CV2 A2 closed, B2 opened

CV3 A3 closed, B3 opened

In order to prevent freezing in the chilled water cooling coil during periods of temperature drop while operating in the space heating mode, the second and third control valves CV2, CV3 are actuated by the controller 30 responsive to a return air flow temperature signal from the sensor 41 in the return air flow. In a first freeze prevention mode, it is desirable to warm the return air flow b entering the cooling coil using the energy from the chilled water source 23. When the return air flow temperature sensor realizes a temperature of between 20 F.–40 F., the controller operates the valves in the first freeze prevention mode according to:

first freeze prevention mode

CV1 A1 closed, B1 opened

CV2 A2 opened, B2 closed

CV3 A3 opened, B3 closed

At times, however, the energy available in the chilled water source may be inadequate. Therefore, in order to prevent freezing in the chilled water cooling coil during periods of severe temperature drop while operating in the space heating mode, e.g. outside air temperature is less than 20 F., the second and third control valves CV2, CV3 are actuated by the controller 30 responsive to a return air flow temperature signal from the sensor 41 to utilize energy from the thermal energy storage tank 16 as necessary. In a second freeze prevention mode, it is desirable to warm the return air flow b entering the cooling coil using the energy first from the chilled water source 23, then from the thermal energy storage tank 16. When the return air flow temperature sensor realizes a temperature less than about 20 F., the controller operates the valves in the second freeze prevention mode according to:

second freeze prevention mode

CV1 A1 closed, B1 opened

CV2 A2 opened, B2 closed

CV3 A3, B3 mixed to maintain temp setpoint at sensor 43 just above the freeze point, and to maintain the setpoint at sensor 45 at about 40 F.

Figure 6:
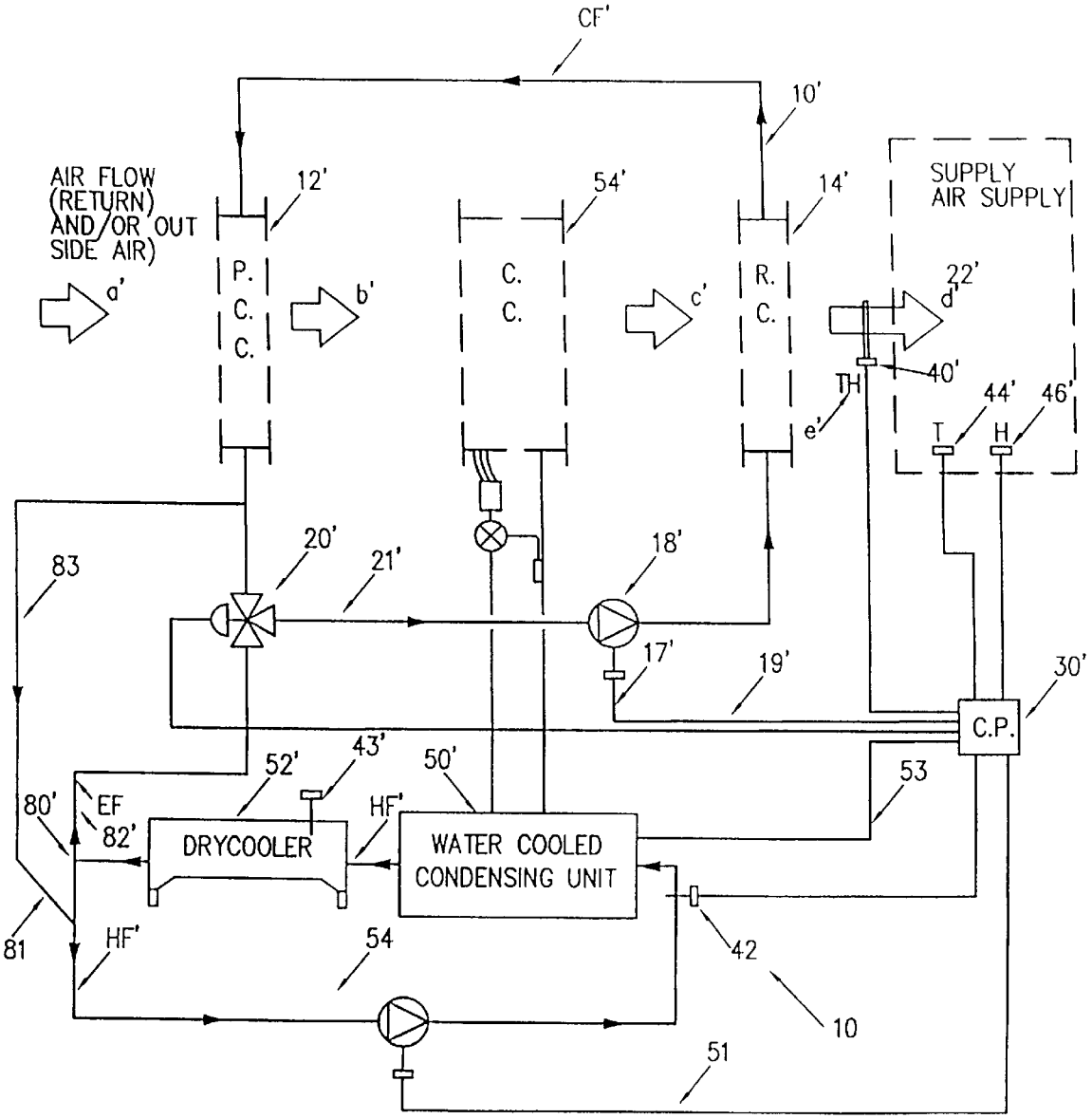
FIG. 6 illustrates a schematic view of a fourth preferred embodiment of the intention for latent heat extraction when used with a water cooled condenser unit type air conditioning system.

Referring now to FIG. 6, an alternative moisture control apparatus 10' for conditioning the air in an occupied space 22' is illustrated. In this embodiment, the working fluid is shared between the air conditioning apparatus and the moisture control apparatus 10'. The air conditioning system is preferably a water cooled compressor condenser type system such as one available from McQuay as model no. RUS-041E. The apparatus 10' comprises suitably arranged components including a precooling coil 12' in a return air flow a', b', a reheat coil 14' in a supply air flow c', d', a working fluid pump 18' for circulating a working fluid through an arrangement of the above coils, a pump drive 17' for controlling the operation of the fluid pump 18' and a control valve 20' for metering the working fluid. The pump and drive may be continuously variable or modulated to motivate an average flow responsive to a duty cycle. An apparatus controller 30' generates a control valve signal for control of the valve 20' and generates pump command signals for control over the working fluid pump 18' to effect a working fluid flow.

With continued reference to FIG. 6, the working fluid includes a coil flow CF', an exchange fluid flow EF, and a heated fluid flow HF'. The coil flow CF' circulates a portion of the working fluid through the reheat and precooling coils 14', 12'. The heated fluid flow HF' passes first through a water cooled condenser unit 50', then through a dry cooler unit 52 motivated by circulating pump 54'. The dry cooler may be substituted with a cooling tower in some applications. The exchange fluid flow EF is routed from a "T"

coupler 80' directly to the control valve 20' through a conduit 82'. The flow of the coil fluid flow CF and the heated fluid flow HF' comprising the shared working fluid are motivated by the working fluid pump 18' upstream of said coupler 80' and the circulating pump 54, respectively. A mixture of exchange fluid flow EF and coil fluid flow CF' is accomplished using the control valve 20', which is responsive to the controller 30', to selectively meter the relative proportions of the bypass and heated fluid flows. A second exchange fluid flow conduit 83 permits a metered portion of the coil fluid flow CF' to return to the condenser loop via valve 20' and the "T" connector 81.

The control valve 20' includes two input ports and an output port. A first input port is connected to the conduit 82' for receiving the exchange fluid flow EF, and the second input port is connected to the precooling coil 12' for receiving the coil fluid flow CF which circulates in the wrap around system, defined by the precooling and reheat coils 12' and 14' respectively. The output port is connected to the series arrangement of the reheat coil 14' and the precooling coil 12' for flowing the coil fluid flow CF' as a mixture of heated fluid from the condenser loop with active fluid in the coil loop.

In the embodiment illustrated, the control valve is a variably adjustable blending valve responsive to an analog signal from the controller 30' for adjusting the relative proportions of the bypass and heated fluid flows over a continuum. As an alternative to the above valve type, the control valve may be a modulated valve responsive to logical signals from the controller 30'. In that alternative case, the duty cycles at the input ports control the blending of the heated and bypass fluid flows.

Also in the embodiment illustrated, the pump drive 17' is responsive to an analog pump speed command signal 19' from the controller 30' to variably control the speed of the working fluid pump 18' over a continuous range. As an alternative to the above, the pump and drive may be of a modulated variety responsive to logical signals from the controller 30'. In that alternative case, the duty cycle of the waveform from the controller 30' controls the fluid pressure and in turn volume of the working fluid circulated through the apparatus. In a further alternative instance, the working fluid pump 18' may provide a constant fluid flow or run at a constant speed in reliance on the mode of the control valve 20' to provide the necessary heat and mixture control.

With continued reference to FIG. 6, the apparatus controller 30' is an operative communication with a plurality of system input devices, each of which sense various physical environmental conditions. These input devices include a supply airflow humidity sensor 40' for sensing the humidity in the supply airflow, a pair of condenser loop working fluid temperature sensors 42' and 43' for sensing the temperature in the condenser loop upstream of the water cooled condenser unit 50' and at the cooler 52' respectively, an occupied space dry bulb temperature sensor 44' for sensing the dry bulb temperature in the occupied space, and an occupied space humidity sensor 46' for sensing the humidity in the occupied space. The humidity sensor 40' may be replaced with a temperature sensor for ease of maintenance and reliability or a combination of a temperature sensor and humidity sensor may be used. In some applications, no sensors will be necessary when the system operates at a calibrated set point.

In addition, the controller 30' is in operative communication with a plurality of active output devices. The output devices are responsive to signals deriving from the apparatus controller 30' according to programmed control procedures detailed below. In the illustrated embodiment, the output devices comprise the control valve 20' responsive to the control valve signal 21', and the variable speed drive 17' responsive to the pump speed command signal 19'. A compressor control signal 53 controls operation of the water cooled compressor unit 50' and a condenser loop fluid flow signal 51 controls the heated fluid flow HF' by operating the pump 54. Additional input and output signals, including alarm and data logging signals or the like, may be added to the basic system illustrated in FIG. 6 as understood by one skilled in the art after reading and understanding the instant detailed description of the preferred embodiments.

In general, the overall system may be used in various operating modes including a space cooling mode, a space dehumidification mode, and a space heating mode. To describe the full operation of the system, each of the operational modes will be described in detail below.

In the space cooling mode, the working fluid pump 18' operates when the refrigeration system compressor 50' is operating. In this mode, the compressor 50' is responsive to the occupied space dry bulb temperature sensor 44'. The pump 18' is driven by the variable speed drive 17' which regulates the water flow to maintain the desired humidity setting at the supply air flow humidity sensor 40'. Water flow is increased on a rise in the relative humidity above a predetermined set point and conversely decreased on a drop in relative humidity at the supply air flow humidity sensor 40' below said set point.

In the space dehumidification mode, the compressor 50' of the conventional air-conditioning unit is operated to maintain the humidity at the occupied space 22', as sensed by the occupied space humidity sensor 46'. The speed of the working fluid pump 18' is regulated to maintain the desired temperature of the occupied space 22' as sensed by the occupied space dry bulb temperature sensor 44'. In this dehumidification mode of operation, working fluid flow WF' is increased on a drop in temperature at the occupied space dry bulb temperature sensor 44', and water flow is conversely decreased on a rise in the occupied space temperature responsive to command signals from the apparatus controller 30' and according to the control algorithms detailed below. When the temperature in the occupied space is a controlling factor in setting the working fluid pump speed, the supply air flow humidity set point is used to establish at a minimum working fluid pump speed. In any or the above modes, working fluid flow control may be accomplished using a two port valve with a modulating actuator in place of the variable speed drive 17'.

In general terms, cooled air leaving the evaporative type cooling coil 54' enters the reheat coil 14' where it absorbs heat from the working fluid flow in the tubes of the reheat coil itself. There is a drop in heat content of the working fluid from points e' to f' equal to the rise in the heat content of the air stream from points c' to d'. The working fluid is transferred through the piping system 32' to the precooling coil 12'. Cooled working fluid from the reheat coil 14' absorbs heat from the return air flow stream as the air passes over the precooling coil surfaces. There is a rise in the heat content in the working fluid from points g' to h' equal to the drop in the heat content of the air stream from points a' to b'. These principles are generally well-known and established in the art.

Figure 7:
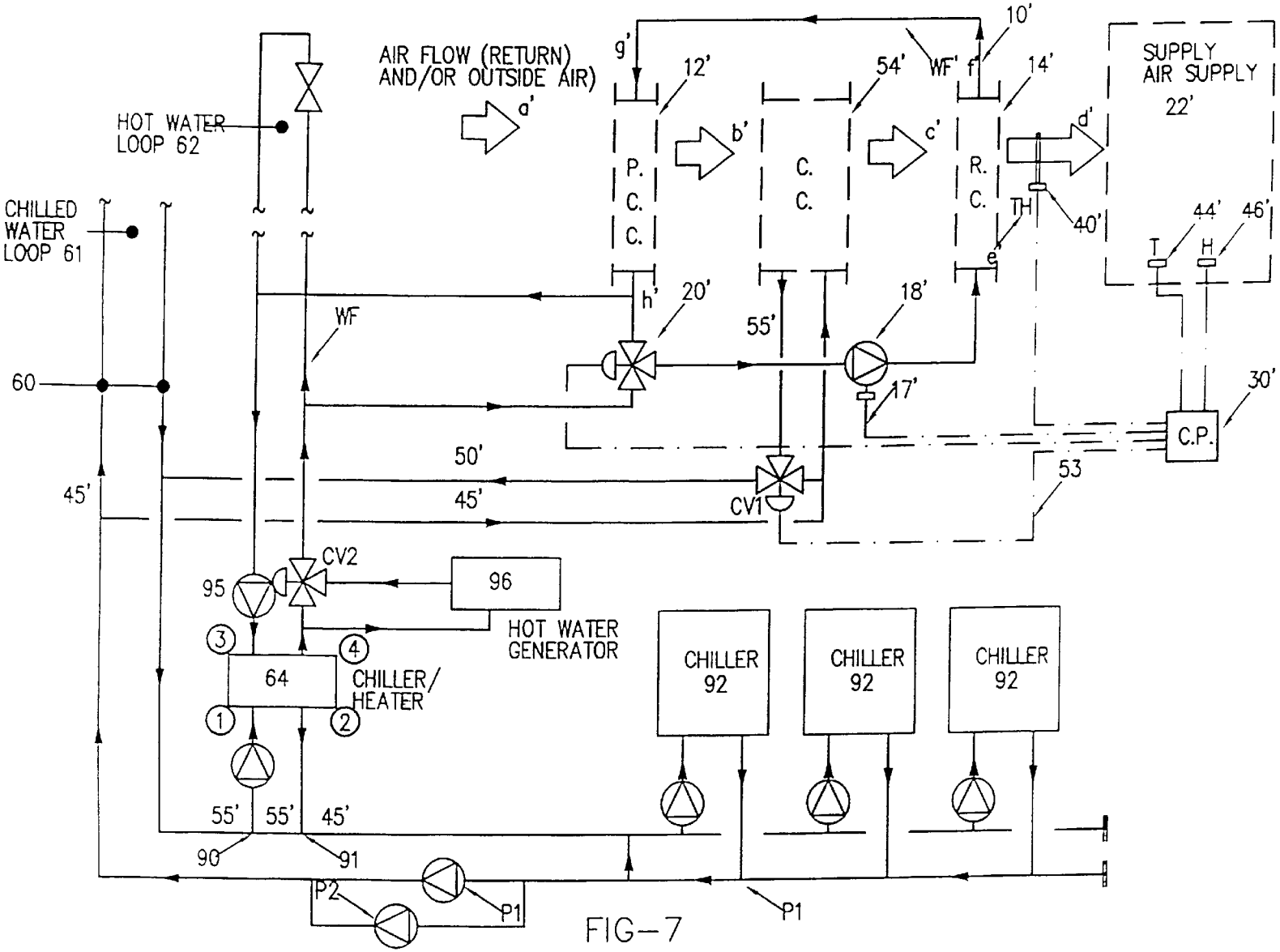
FIG. 7 illustrates a schematic view of a fifth preferred embodiment of the invention for latent heat extraction when used with a chilled water/heater type air conditioning system.

With particular reference now to FIG. 7, a schematic diagram of another embodiment of the apparatus of the invention is illustrated adapted for use with a conventional chiller/heater air-conditioning unit having a plurality of staggered chiller units. The system includes a compressor for compressing a compressible fluid and a condenser coil. A chiller water cooling coil 54" absorbs heat from a return air flow a", b" resulting in a cooled supply air flow c", d" into an occupied space 22".

With continued reference to FIG. 7, a reheat coil 14", as described above, is placed in the supply air flow c", d" after (downstream of) the evaporative cooling coil 54", while a precooling coil 12" is placed in the return air flow a", b" before (upstream of) the cooling coil 54". For full effectiveness of the air quality control measure of the instant invention, the reheat coil 14" should be physically mounted as close as possible to the cooling coil 54". The precooling coil 12" can be mounted in any convenient location and may be so situated as to precool only the outside air, only the return air, or a mixture of the outside air and return air as described above in connection with the earlier embodiments.

As above, the working fluid pump 18" is connected to a variable speed drive 17" which operates to circulate the working fluid WF" between the reheat coil 14", the precooling coil 12", the mixing valve 20", and the chiller heater unit 54". In this preferred embodiment, the working fluid is water. In general, the overall system may be used in various operating modes including a space cooling mode, a space dehumidification mode, and a space heating mode. To describe the full operation of the system, each of the operational modes will be described in detail below.

In this preferred embodiment illustrated, when there is a demand for primary cooling, pumps P1 and P2 operate to deliver chilled water to the cooling coil 54". A control valve CV1 regulates the amount of chilled water flow through the cooling coil. The chilled water in the cooling coil is warmed by the action of the cooling cycle from flow b" to flow c". The warmed chilled water is exhausted through the control valve CV1 and flows downward as illustrated in the FIGURE toward the "T" coupling 90. If there is a demand for heating in the hot water circulating loop 62, the chiller heater 64" is operated and therefore the pump P1 operates to introduce the return chilled water to the chiller/heater 64". The returned chilled water is cooled by the flow into the chiller/heater 64" at node 1 and out therefrom at node 2. The energy that is extracted from the chilled water via flow into node 1 and out of node 2 of the chiller/heater 64" is added to the hot water circulating loop 62 for use in the building heating system and as a source of reheat energy, which, according to the teachings of this embodiment, flows through the wrap around system comprising the precooling coil 12" and the reheat coil 14".

The water leaving the chiller/heater at node 2 is of course colder than the water entering at point a because heat energy is extracted and imparted into the hot water circulating loop. The chilled water circulating loop 61 is therefore benefited by a reduction in temperature. The cold water is reintroduced into the main chilled water return flow at the "T" connection 91. The combined fluid flow leaving node 91 is colder than the main flow and may be considered to be "pre-cooled." The combined flow then proceeds to the main chiller plan for further recirculation to a succession of chiller units 92–94. The chiller/heater unit 64" is advantageously used in this embodiment to simultaneously provide a cooling of the chilled water circulating loop 61 while simultaneously imparting the heat extracted from the chilled water into the not water circulating loop 62.

The control valve 20" is operated under the direction of the control unit 30". The amount of heat extracted from the chilled water circulating loop 61 by the chiller/heater 64" is dependent upon the heat load in the associated building or environment. If there is not a sufficient heat load in the building, then the chiller/heater 64" is not operated. However, as the heat load in the building increases, additional cooling of the chilled water in the chilled water circulating loop 61 is performed.

Thus, the heating of the hot water in the hot water circulating loop 62 is complimentary to the cooling of the chilled water in the chilled water circulating loop 61 by the action of the chiller/heater 64". In this preferred embodiment, the chiller/heater is a conventional vapor compression type unit. A flow of fluid into node 1 and out of node 2 is separated from the flow into node 3 and out of node 4.

In the space cooling mode, the working fluid pump 18" operates when the refrigeration system is operating. In this mode, the flow through the coil 54" is responsive to the occupied space dry bulb temperature sensor 44". The pump 18" is driven by the variable speed drive 17" which regulates the water flow to maintain the desired humidity setting at the supply air flow humidity sensor 40". Water flow is increased on a rise in the relative humidity above a predetermined set point and conversely decreased on a drop-in relative humidity at the supply air flow humidity sensor 40" below said set point.

In the space dehumidification mode, the flow through the coil 54" of the conventional chilled water air-conditioning unit is increased to maintain the humidity at the occupied space 22", as sensed by the occupied space humidity sensor 46", the speed of the working fluid pump 18" is regulated to maintain the desired temperature of the occupied space 22" as sensed by the occupied space dry bulb temperature sensor 44". In this dehumidification mode of operation, working fluid flow WF" is increased on a drop in temperature at the occupied space dry bulb temperature sensor 44", and water flow is conversely decreased on a rise in the occupied space temperature responsive to command signals from the apparatus controller 30" and according to the control algorithms detailed below. When the temperature in the occupied space is a controlling factor in setting the working fluid pump speed, the supply air flow humidity set point is used to establish at a minimum working fluid pump speed. In any of the above modes, working fluid flow control may be accomplished using a two-port valve with a modulating actuator in place of the variable speed drive 17".

In general terms, cooled air leaving the cooling coil 54" enters the reheat coil 14" where it absorbs heat from the working fluid flow in the tubes of the reheat coil itself. There is a drop in heat content of the working fluid from points e" to f" equal to the rise in the heat content of the air stream from points c" to d". The working fluid is transferred through the piping system to the precooling coil 12". Cooled working fluid from the reheat coil 14", absorbs heat from the return air flow stream as the air passes over the precooling coil surfaces. There is a rise in the heat content in the working fluid from points g" to h" equal to the drop in the heat content of the air stream from points a" to b". These principles are each generally well-known and established in the art.

Heat exchange pump 95 operates when the chiller/heater 64 is operating and when the temperature in the hot water circulating loop 62 is below a predetermined set point. The function of the heat exchange pump 95 is to transfer working fluid heated by the hot refrigerant gas to the hot water circulating loop 52. The general function of the chiller/heater 64" is to both chill the water in the chilled water circulating loop 61 and provide supplemental heat to charge the hot water circulating loop 62 with hot working fluid for heating and/or reheat operation.

Figure 8:
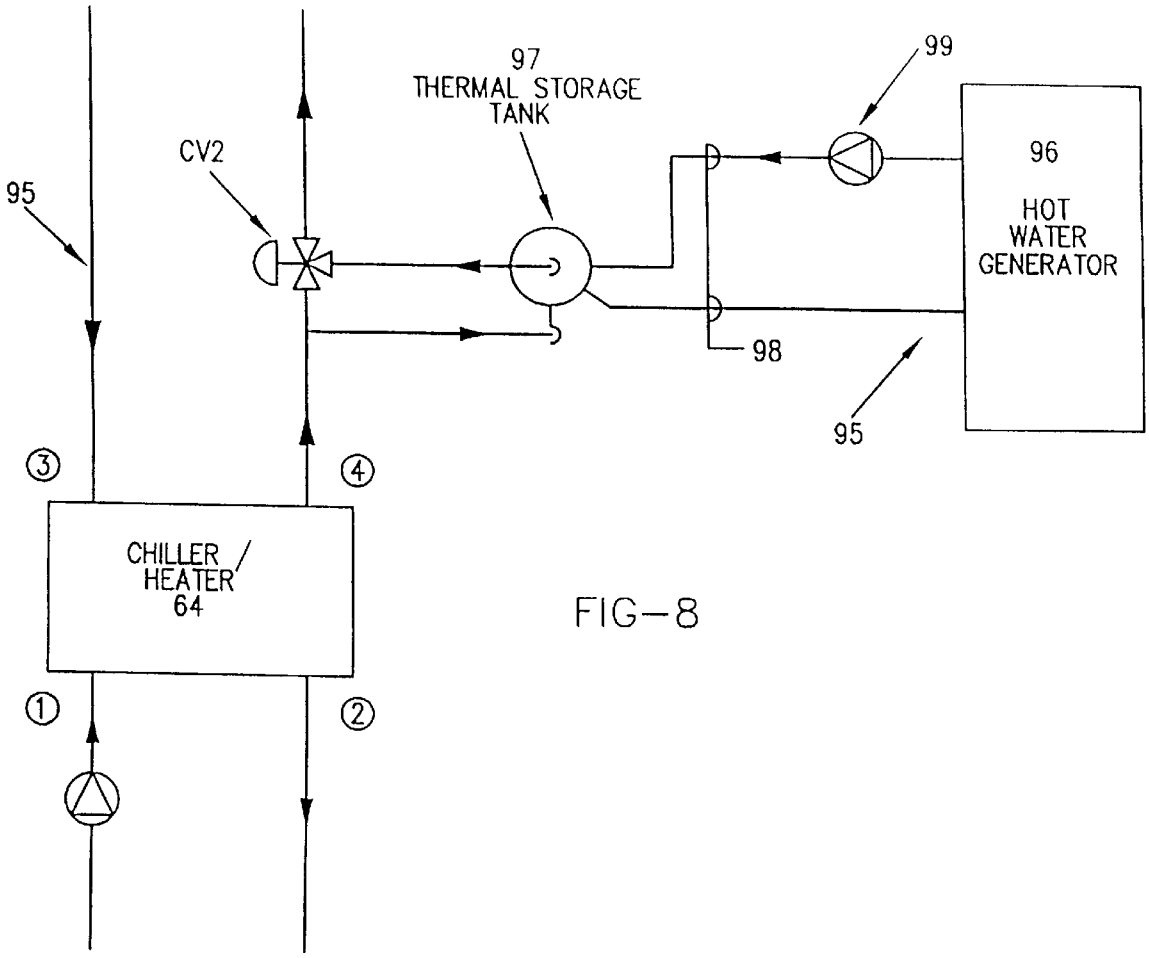
FIG. 8 illustrates a schematic view of a thermal storage system for use in the apparatus illustrated in FIG. 5.
Figure 9A:
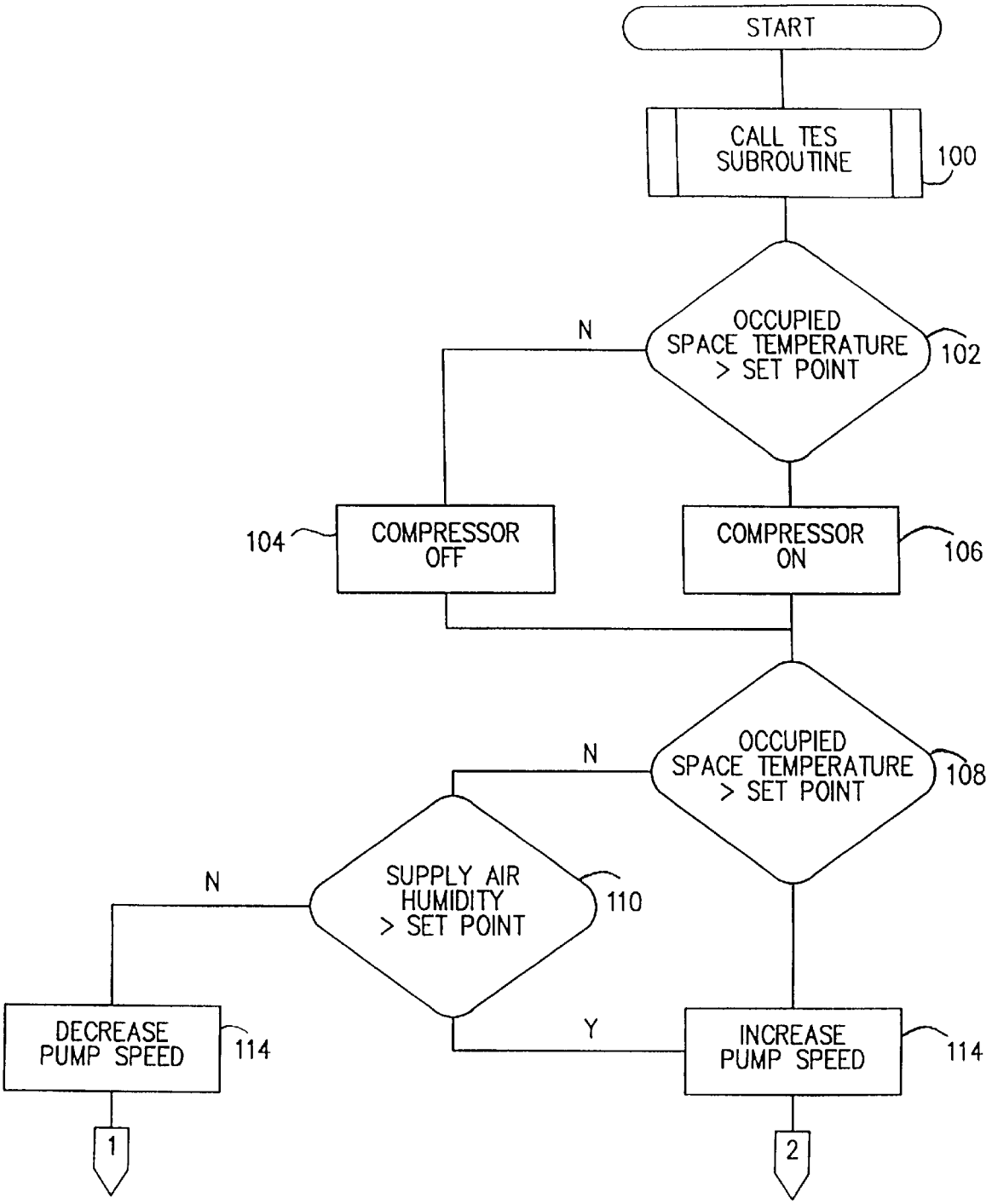
FIGS. 9*a*, 9*b* are flow charts of the control procedure executed by the control apparatus during the space cooling mode of operation.
Figure 9B:
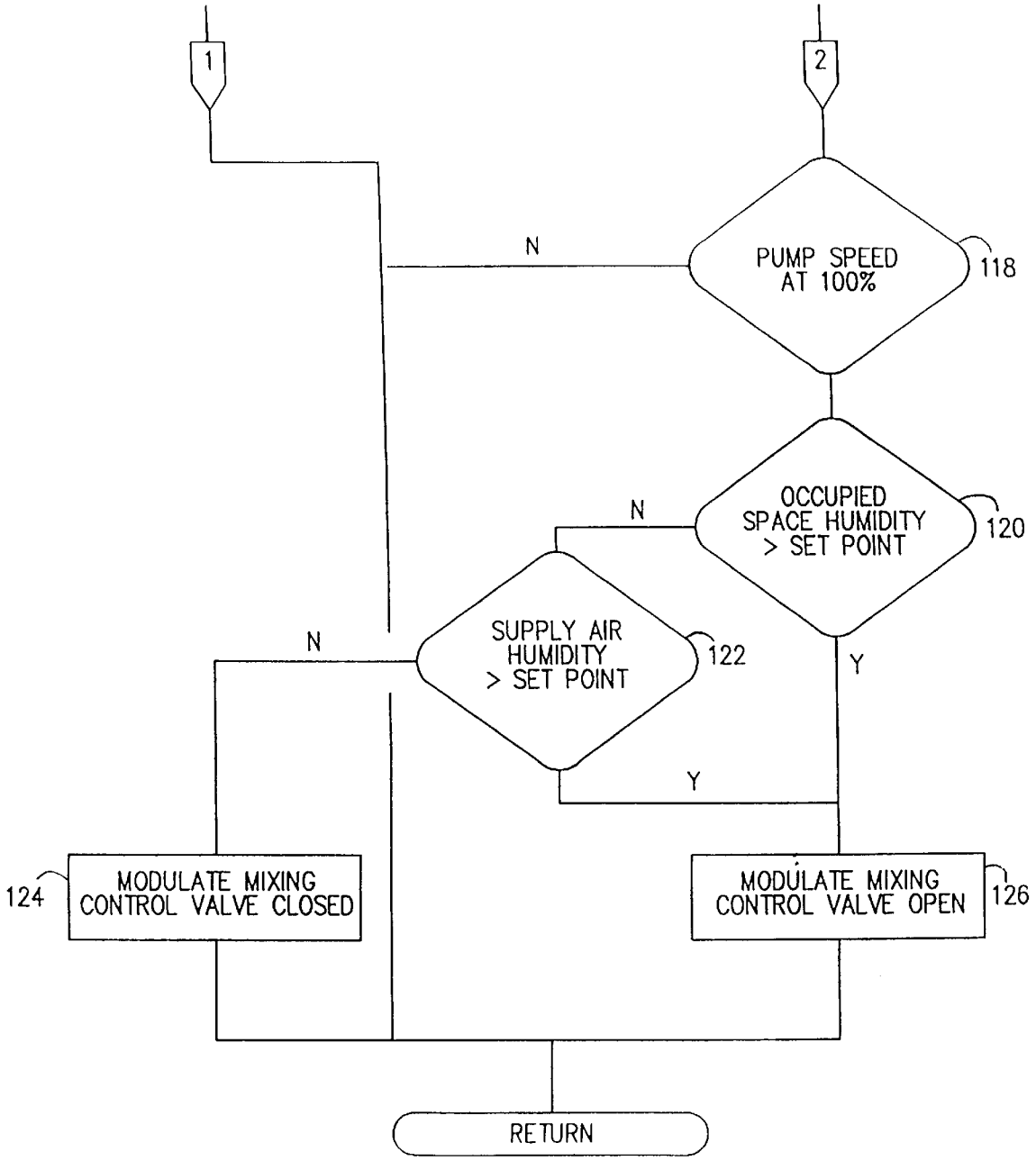
Figure 10A:
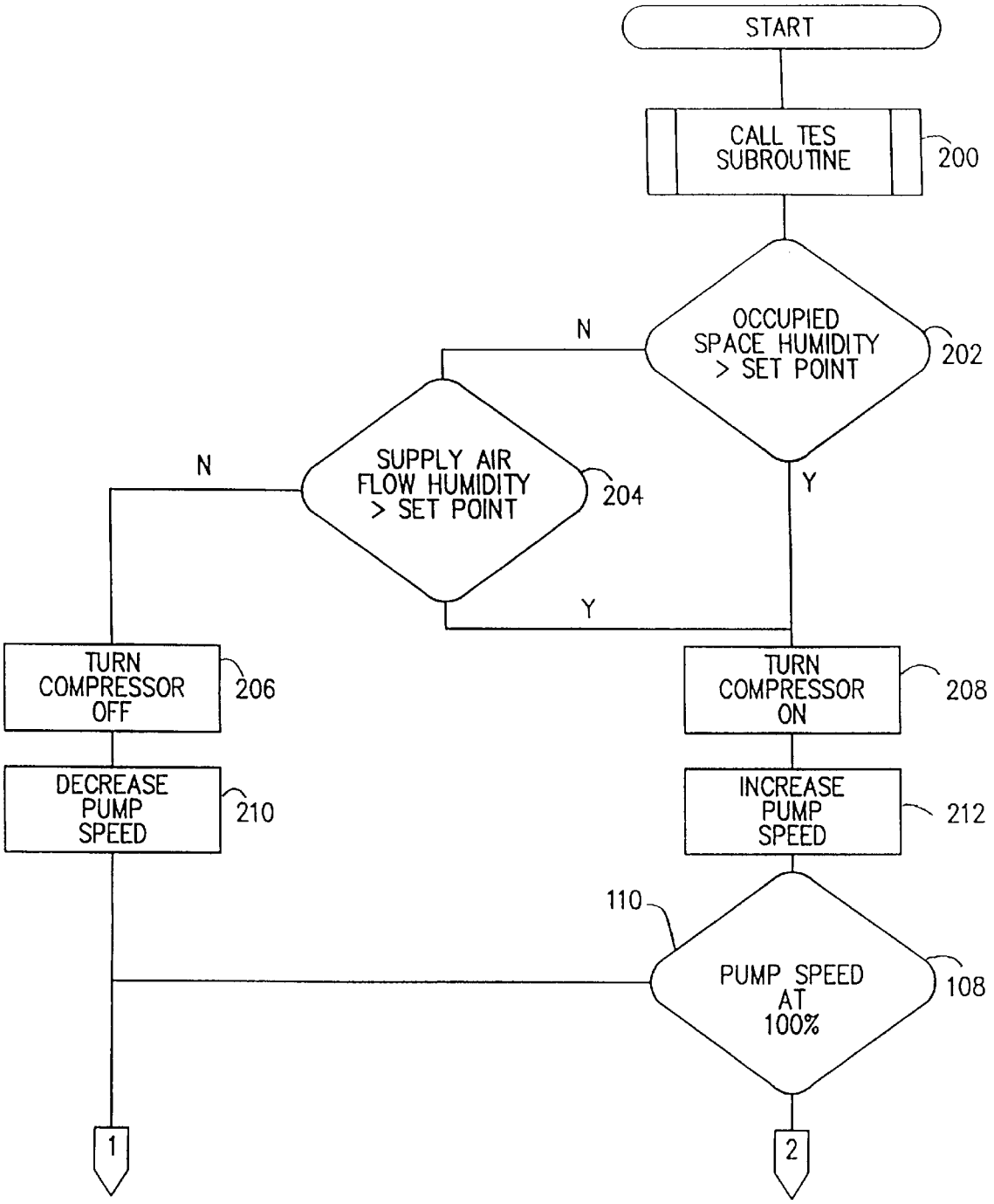
FIGS. 10*a*, 10*b* are flow charts of the control procedure executed by the control apparatus during the space dehumidification mode of operation.
Figure 10B:
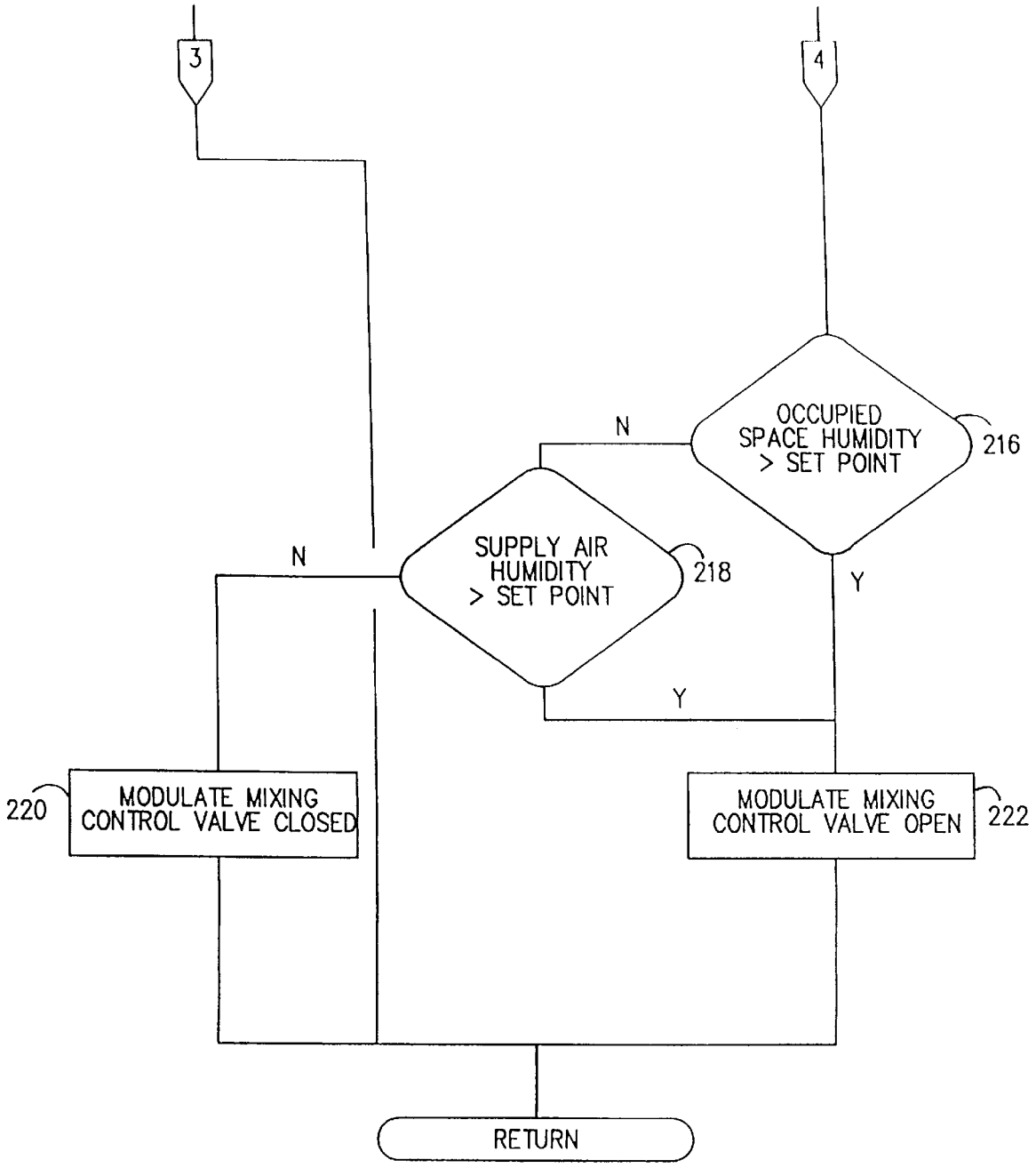
Figure 11:
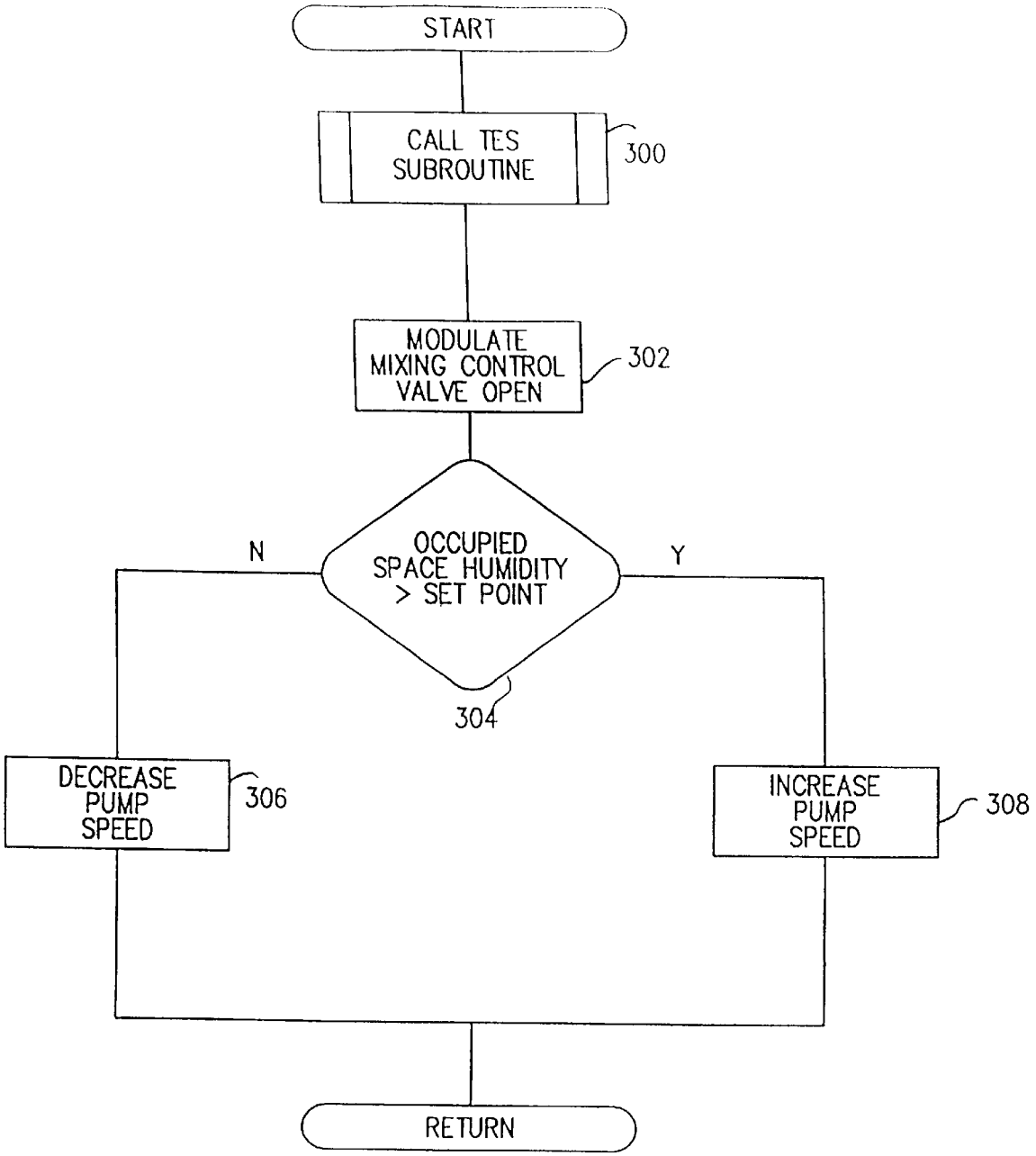
FIG. 11 is a flow chart of the control procedure executed by the control apparatus during the space heating mode of operation.

Referring now to FIG. 8, an auxiliary hot water generator 95 is illustrated for use with the apparatus shown in FIG. 7. The hot water generator 95 includes a thermal storage tank 96 which is connected to an electric hot water generator 97 through a pair of conduits 98. A one of the pair of conduits includes a fluid pump mechanism 99 which motivates a fluid flow between the electric hot water generator 97 and the thermal storage tank 96. A control valve CV2 meters the flow of hot water from the hot water generator 95 into the hot water circulating loop 62. The auxiliary hot water generator 95 is useful in situations where additional heat is required in the hot water circulating loop but system conditions prevent the operation of the chiller/heater 54".

With reference now to FIGS. 2, 3, 6, 7, 9*a*, and 9*b*, the control method for the space cooling mode operation will be described. In the space cooling mode, the compressor 50 of FIG. 2 and the chilled water cooling coil 70 of FIG. 3 are operated 104, 106 to maintain the desired set point dry bulb temperature in the occupied space 22 according to the occupied space dry bulb Temperature sensor 44. In the conventional air-conditioning system, the compressor 50 starts 106 on a rise in occupied space temperature above a predetermined set point and stops 104 on a fall in occupied space temperature below the set point temperature 102 as sensed by the occupied spaced dry bulb temperature sensor 44. Correspondingly, in the chilled water system, the control valve 20 opens 106 on a rise in the occupied space temperature and closes 104 on a fall in the occupied space temperature below the predetermined set point at occupied space dry bulb temperature sensor 44. In either case, the speed of the working fluid pump 18 is regulated by the variable speed drive 17 to maintain the desired relative humidity 110 in the supply air flow d as sensed by the supply air flow humidity sensor 40.

The pump speed is also controlled to maintain the desired relative humidity 108 in the occupied space 22 according to the occupied space humidity sensor 46. The working fluid pump speed increases 114 on a rise in the relative humidity above the supply air or the occupied space air relative humidity set points. The working fluid pump speed decreases 112 on a fall in the relative humidity below the set points.

When the variable speed drive 17 is at full speed 118, the control valve 20 is modulated to maintain the desired humidity set points 120, 122. The control valve 20 is positioned to bypass the thermal energy storage tank 16 when the working fluid pump 18 is operating ac speeds of less than 100% of full speed. When the variable speed pump 18 is at full speed, the control valve 20 is modulated open 126 to the thermal energy storage tank 16 on a rise in supply air 122 or occupied space 120 relative humidity above the predetermined set points according to the supply air flow humidity sensor 40 and the occupied space humidity sensor 46 respectively. In this state, the working fluid flows to the reheat coil 14 directly from the thermal energy storage tank 16 as a heated working fluid flow HF. The control valve 20 is modulated closed 124 on a decrease in the supply air or occupied space or relative humidity below the predetermined set points.

Next, with reference to FIGS. 2, 3, 6, 7, 10*a* and 10*b*, the control method for the space dehumidification operating mode will now be described. During this mode, when the occupied space dry bulb temperature set point is satisfied according to the occupied space dry bulb temperature sensor 44, the compressor 50 of the conventional air conditioning unit is operated to maintain the desired occupied space relative humidity. In the chilled water system, the water control valve 72 is operated to maintain the desired occupied space relative humidity. In this mode, the compressor 50 or the chilled water control valve 72 operate 208 on a rise in the occupied space relative humidity 202 above the set point and stop 206 on a drop in the occupied space relative humidity 202 below said set point. The working fluid pump 18 and control valve 20 are controlled 210–222 according to the space cooling mode described above.

With reference next to FIGS. 2, 3, 6, 7 and 11, the control method for the space heating operating mode will now be described. In this mode, the thermal energy storage tank 16 is utilized to maintain the desired occupied space dry bulb temperature according to the physical conditions sensed by the occupied space humidity sensor 46. Normally in this mode, the compressor 50 and chilled water control valve 72 are both off in the standard air-conditioning system and chilled water systems respectively. In the instant space heating mode, the working fluid WF is circulated exclusively through the thermal energy storage tank 16 as a heated fluid flow HF. No flow is permitted through the bypass as a bypass fluid flow BP. This is accomplished via the control valve 20 modulated open 302 according to the control valve signal 21 from the apparatus controller 30. The speed of the working fluid pump 18 is adjusted 306, 308 to maintain the desired temperature set point 304 in the occupied space 22. As an alternative means, the working fluid pump 18 may be continuously operated, but cycled on and off according to the demand for heating as sensed by the occupied space dry bulb temperature sensor 44. This results in an average heating defined by the duty cycle of the alternating on/off cycles.

Figure 12:
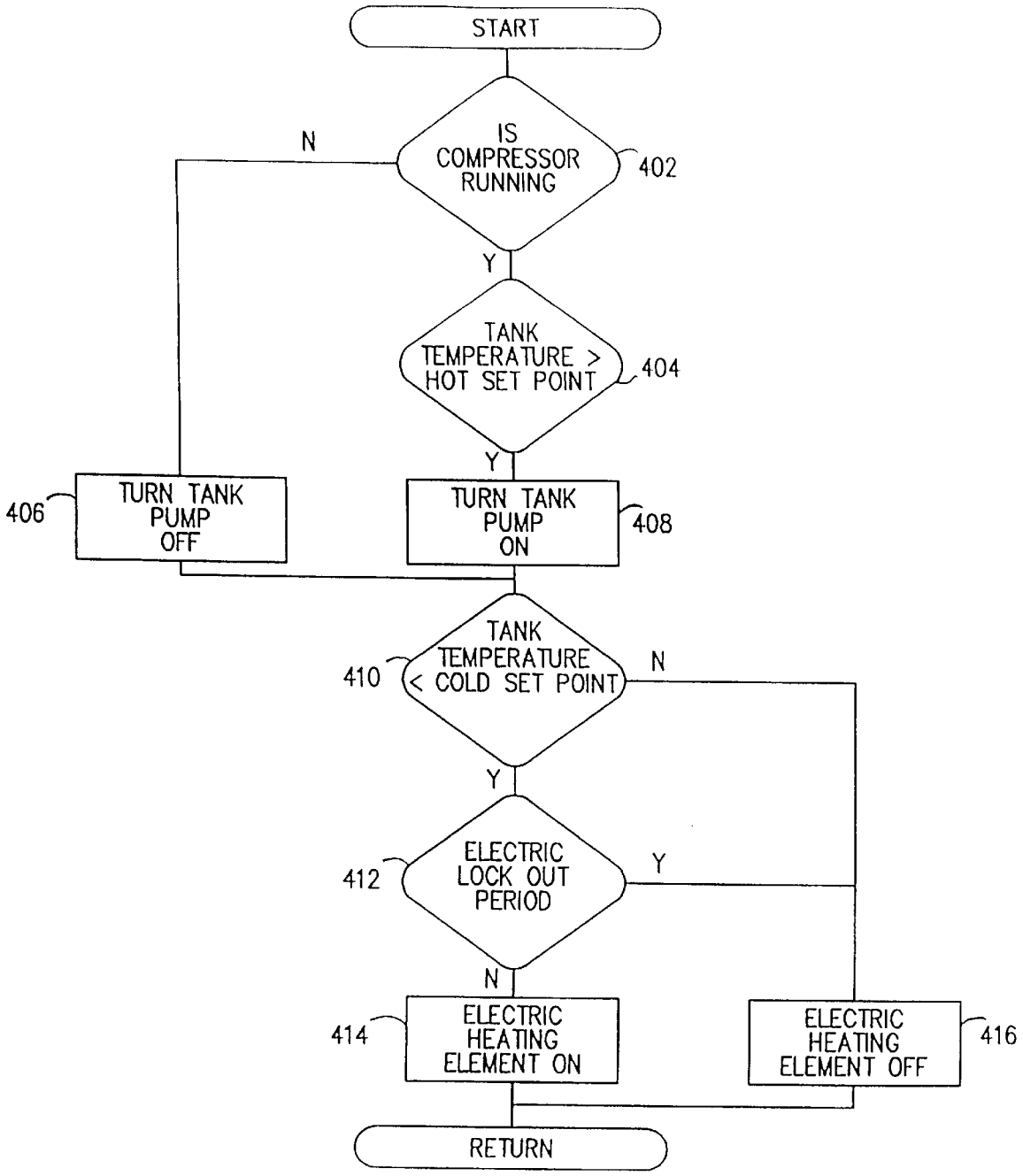
FIG. 12 is a flow chart of the control procedure executed by the control apparatus during the various operational modes for maintenance of the thermal energy storage tank temperature used in the first preferred embodiment.

With reference now to FIG. 12, the thermal energy storage tank maintenance routine TES for use with the embodiments illustrated in FIGS. 1–3, will be now described in detail. The method is a subroutine in each of the space cooling, space dehumidification, and space heating control methods/modes described above. In this control subroutine procedure, heat exchange pump 58 operates 408 when the compressor 50 is operating 402 and when the temperature in the thermal energy storage tank 16 is below the set point 404 at temperature sensor 42. The function of pump 58 is to transfer water WF heated by the hot refrigerant gas in the hear exchanger 56. The pump stops 406 when the temperature in the tank is at the upper water temperature set point 404 at the temperature sensor 42. The function of the heat exchanger is to provide supplemental heat to charge the thermal storage tank 16 with hot water for heating and/or reheat operation.

Electric heating element 60 may be used as an additional energy source to heat the water when there is a demand for more heat than can be provided by the heat exchanger. The electric heating operation is controlled by the apparatus controller 30 to operate 414 as the second source of energy when the temperature in the thermal storage tank 16 drops below the desired set point 410 at sensor 42. As an example, if the desired minimum temperature in the tank is 120 F. and the desired maximum temperature is 125 F., the pump 58 starts on a drop in temperature below 125 F. When the tank temperature drops to 120 F., the electric heating element 60 is activated. On a rise in tank temperature the heating elements are turned off first 416, and on a continued rise in temperature to 125 F. the pump 58 is, in turn, shut off 406. Multiple heating elements may be provided and controlled by a step controller to match the energy input to the heating load in stages of electric heat or an SCR controller can be used to proportionately control the amount of heat energy added to the tank as a function of the tank temperature differential from minimum to maximum set points.

The electric heating controls may further be circuited to allow for a lock out 416 of the electric heating elements during periods of peak community electrical demand 412. This lock out control could be provided from an external signal such from the power company or from the home or business owner's energy management system. The control could be from a signal from the system controls contained in control 30 as a function of time of day, demand limiting, or other energy management strategies.

With reference once again to FIG. 2, 6 and 7 the system may be operated in a variety of modes. In general, when the overall, system is operating in either the cooling mode or the dehumidifying mode the cold air leaving the evaporator coil 50 enters the reheat coil 14 where it absorbs heat from the moving water stream WF in the tubes of the reheat coil 12. There is a corresponding drop in the heat content of the circulating water from points e to f equal to the rise in heat content of the air stream from points c to d. The working fluid (water) WF is transferred through a piping conduit system to the precooling coil. Cold water entering the precooling coil 12 absorbs heat from the return air stream as it passes over the coil surfaces. There is a rise in heat content of the circulating water from points g to h equal to the drop in heat content of the air stream from points a to b. Representative sample calculations follow below.

SAMPLE CALCULATIONS

Figure 13:
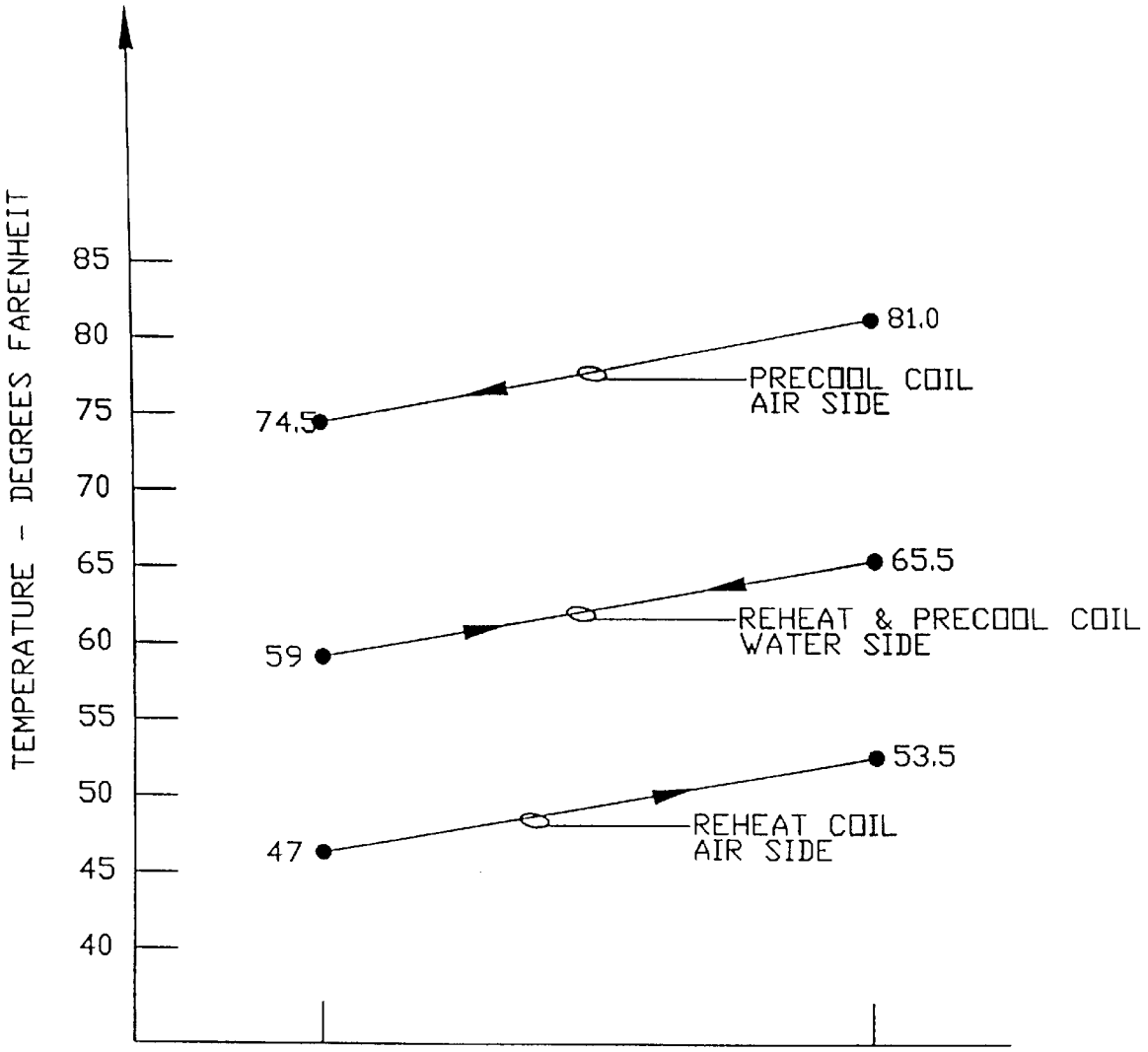
FIG. 13 is a coil graph of a first sample calculation.
Figure 16A:
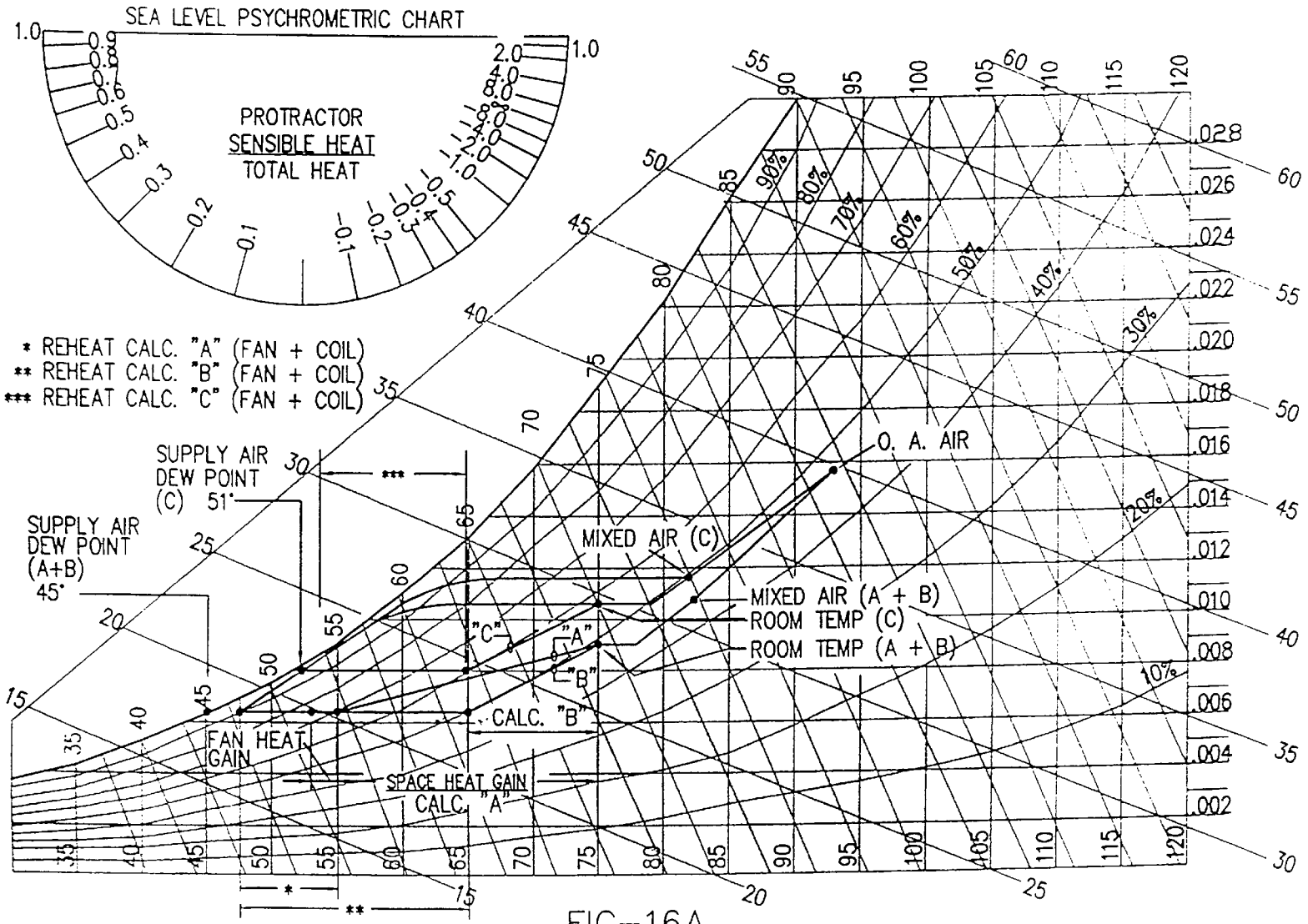
FIGS. 16*a* and 16*b* are a psychometric chart of the combined first, second and third sample calculations and a protractor for use with the psychometric chart.
Figure 16B:
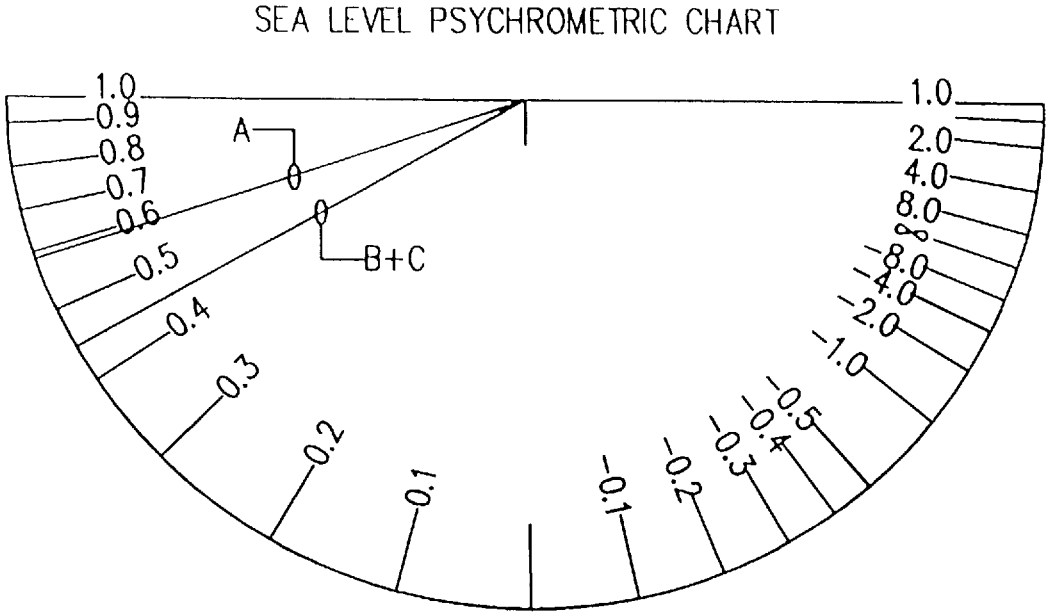

The sample calculation A immediately below is illustrated in the coil graph of FIG. 13 and in the psychometric chart of FIGS. 16*a*, 16*b* wherein it is Given that Required indoor temperature is 75° F. at 45% relative humidity;

Indoor cooling load (peak load) is

| | |
|---|---|
| 220.0 | MBTU/Hour Sensible |
| 94.3 | MBTU/Hour Latent |
| 314.3 | MBTU/Hour Total; |

Outdoor air temperature at peak cooling load is 93° F. dry bulb and 76° dry wet bulb;

Amount of ventilation air (outside air) required is 2500 CFM;

Desired supply air relative humidity level is 70% maximum;

Return air heat gain assumed equal to a 2° F. ΔT rise; and

Fan and motor heat gain assumed equal to a 1½° F. ΔT rise.

Statement of Solution

Sensible heat ratio $= \frac{220.0}{314.3} = 0.70$

Room condition line intersects 70% RH line at 55° F.
Supply air volume required:

$$V = \frac{220000 \text{ BTU/HR}}{1.1 \cdot 20° \Delta T}$$

Reheat energy required to provide 70% Rel. Hum. in supply air stream:
Q = 10000 CFM · 1.1 · [(55 − 47) °F.ΔT − 1½° F.)]
= 71500 BTU/HR
Water flow rate required through reheat coil -continued assuming 6½° F. ΔT and 12° F. approach temperature:
V = 71500 BTU/Hour/(500 · 6.5° F. ΔT) = 22 GPM
Coil conditions - Temperature:

| | Air | Water |
|---|---|---|
| Entering Coil | 47 | 65.5 |
| Leaving Coil | 53.5 | 59.0 |

Precooling coil air temperature drop (sensible cooling):

$$\Delta T = \frac{O}{1.1 \cdot CPM}$$

Q = Amount of energy recovered for supply air stream at reheat coil
ΔT = 71500 BTU/Hour/1.1 · 10000 CFM = 6.5° F. ΔT
Coil conditions - Temperature

| | Air | Water |
|---|---|---|
| Entering Coil | 81 | 59 |
| Leaving Coil | 74.5 | 65.5 |

Figure 14:
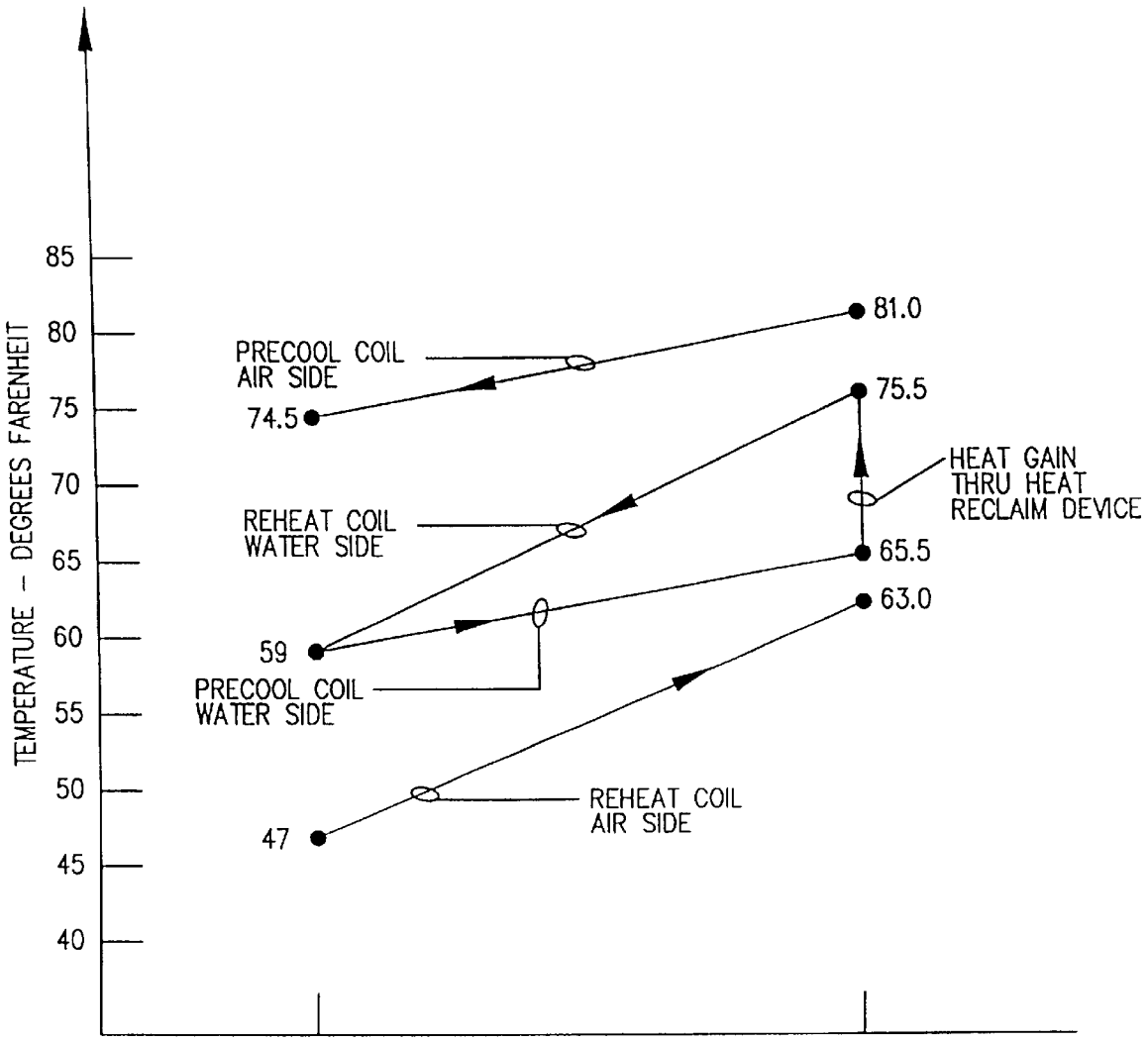
FIG. 14 is a coil graph of a second sample calculation.

The sample calculation B immediately below is illustrated in the coil graph of FIG. 14 and in the psychometric chart of FIGS. 16*a*, 16*b* wherein it is Given that Same condition as calculation (A), except indoor sensible cooling load is 110.0 MBTU/Hour; and, Assume supply air dew point is fixed at 45° F. due to coil characteristics;

Statement of Solution

New sensible heat ratio $$\frac{110.0}{110 + 94.3} = 0.54$$

Reheat energy required
Q = 10000 CFM · 1.1 · [(65 − 47) °F.ΔT − 1½° F.)]
= 181500 BTU/hour
Water temperature required using 22 GPM flow rate $$\Delta T = \frac{181500 \text{ BTU/hour}}{22 \text{ GPM} \cdot 500} = 16.5° \Delta T \text{ °F.}$$

Reheat energy required from refrigerant heat recovery:
$Q_3 = Q_1 - Q_2$
$Q_1$ = Total reheat required
$Q_2$ = Water heat gain in precooling coil (from Calculation (A))
$Q_3$ = 181500 − 71500 BTU/hour = 110,000 BTU/hour
Temperature rise required by water through heat reclaim device:

$$\Delta T = \frac{Q_3}{500} \cdot 22 \text{ GPM} = \frac{110000}{500} \cdot 22 \text{ GPM} = 10° \text{ F.}$$

Figure 15:
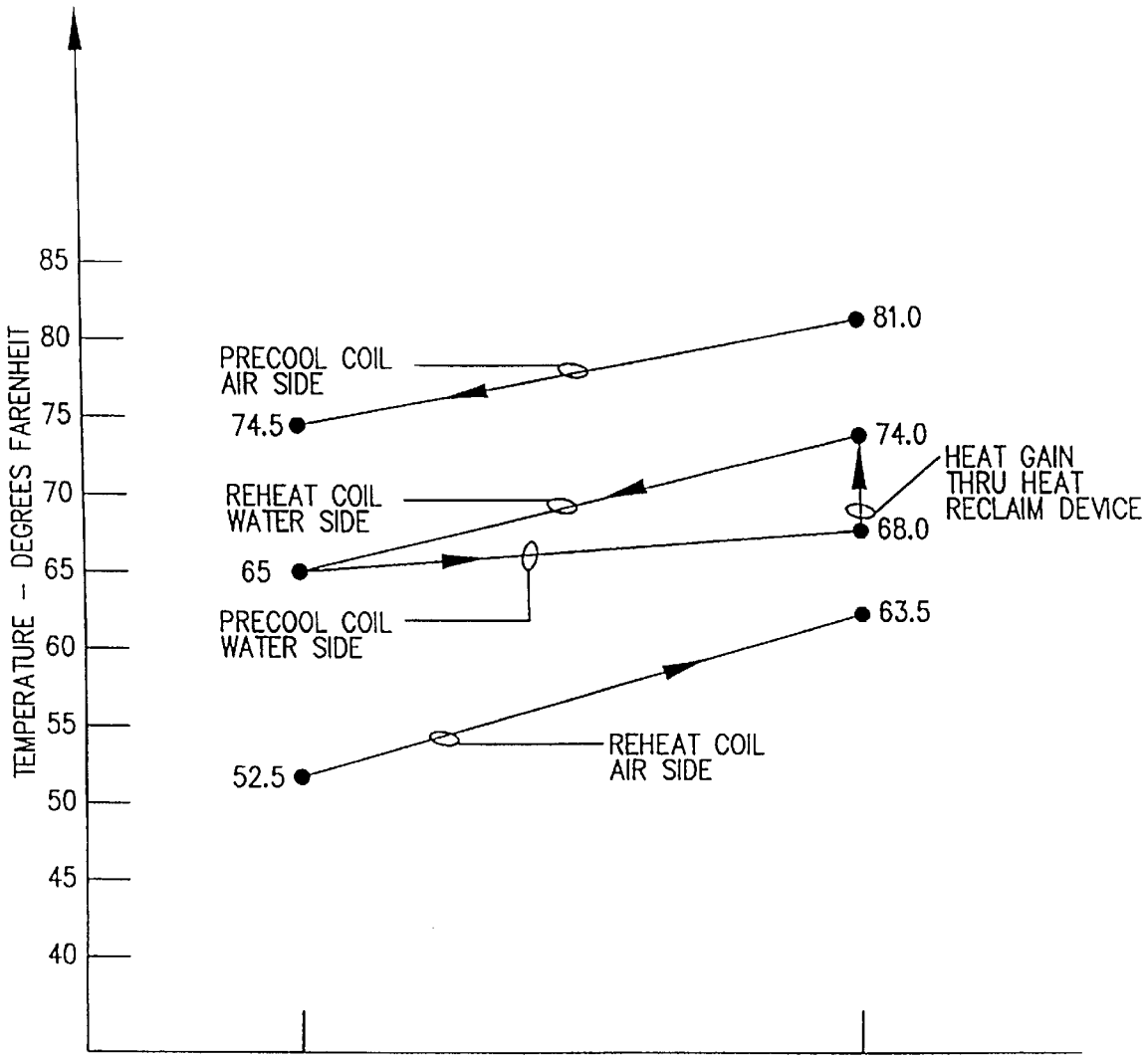
FIG. 15 is a coil graph of a third sample calculation.

The sample calculation C immediately below is illustrated in the coil graph of FIG. 15 and in the psychometric chart of FIGS. 16*a*, 16*b* wherein it is Given that:

Same conditions as Calculation (A), except:

Space sensible cooling load is 110 MBTU/hour

Refrigeration compressor(s) provided with capacity reduction to reduce amount of refrigerant flow, matching the new cooling load; this results in an increased dew point in the supply air.

Statement of Solution

Assuming capacity reduction raises the supply air dew point to 51° F.;

Space condition line intersects dew point line as 65° F. db, this is the supply air dry bulb temperature; space condition line extends up and to the right, establishing a new room condition of 75° F. at~53% relative humidity.

The sample calculation immediately below illustrates the Heating Mode of operation wherein it is Given that Space heating load is 216000 BTU/Hour, peak;

Supply air volume is 10,000 CFM (from Calculation (A));

Desired space temperature is 72° F.;

Outside air temperature is 35° F.; and,

Outside air volume is 2500 CFM.

Statement of Solution

Supply air temperature required is $$T_s = \frac{72^\circ \text{ F. } 21600 \text{ BTU/hour}}{1.1 \cdot 10000 \text{ CFM}} = 72^\circ \text{ F.} + 20 = 92^\circ \text{ F.}$$

Mixed air temperature is:

$$T_m = 72^\circ \text{ F.} \left[ \frac{216000 \text{ BTU/hour}}{10000 \text{ CFM}} \cdot (72 - 35)^\circ \text{F.} \right]$$

$$= 62.75^\circ \text{ F.}$$

Total heating required $Q = 1.1 \cdot 10000 \text{ CFM} \cdot (92 - 62.75)\ ^\circ\text{F.}$ $= 321750 \text{ BTU/hour} = 94 \text{ KW}$ Heat provided from thermal storage -

ASSUMPTIONS: full heating shift to OFF peak, 10 hour heating period, 60% diversity.

Heating required:

$Q = 10 \text{ hours} \cdot 321750 \text{ BTU/hour} \cdot .6 \text{ diversity}$ $= 1930500 \text{ BTU}$ Heat input to thermal storage:

During moderate temperature periods recovered heat would be used to charge the storage tank. During cold weather, when the cooling system is off, the electric heat would be used to store the energy.

Electric heater size:

$Q = 1930500 \text{ BTU}/14 \text{ hours} = 137900 \text{ BTU/hour}$ $= 40 \text{ KW}^*$ Thermal storage volume required -

ASSUMPTIONS: minimum useful temperature is 100° F. and storage temperature is 140° F.

$$V = \frac{1930500 \text{ BTU}}{8.35 \text{ lb/gal.} \cdot 1 \text{ BTU/lb. }^\circ\text{F.} \cdot (140 - 100)^\circ\text{F.}}$$

$V = 5780$ Gallons

The amount of storage could be reduced if the electric heat is allowed to operate during the peak period (at a reduced rate to provide some demand saving):

$$V = \frac{1930500 \text{ BTU} - 10 \text{ hrs} \cdot 20 \text{ KW} \cdot 3413 \text{ BTU/KW}}{8.35 \text{ lb/gal.} \cdot 1 \text{ BTU/lb.}^\circ\text{F.} \cdot (140 - 100)^\circ\text{F.}}$$

$V = 3736$ Gallons

*Heater size and/or storage volume would be increased slightly to account for system loses.

Figure 17:
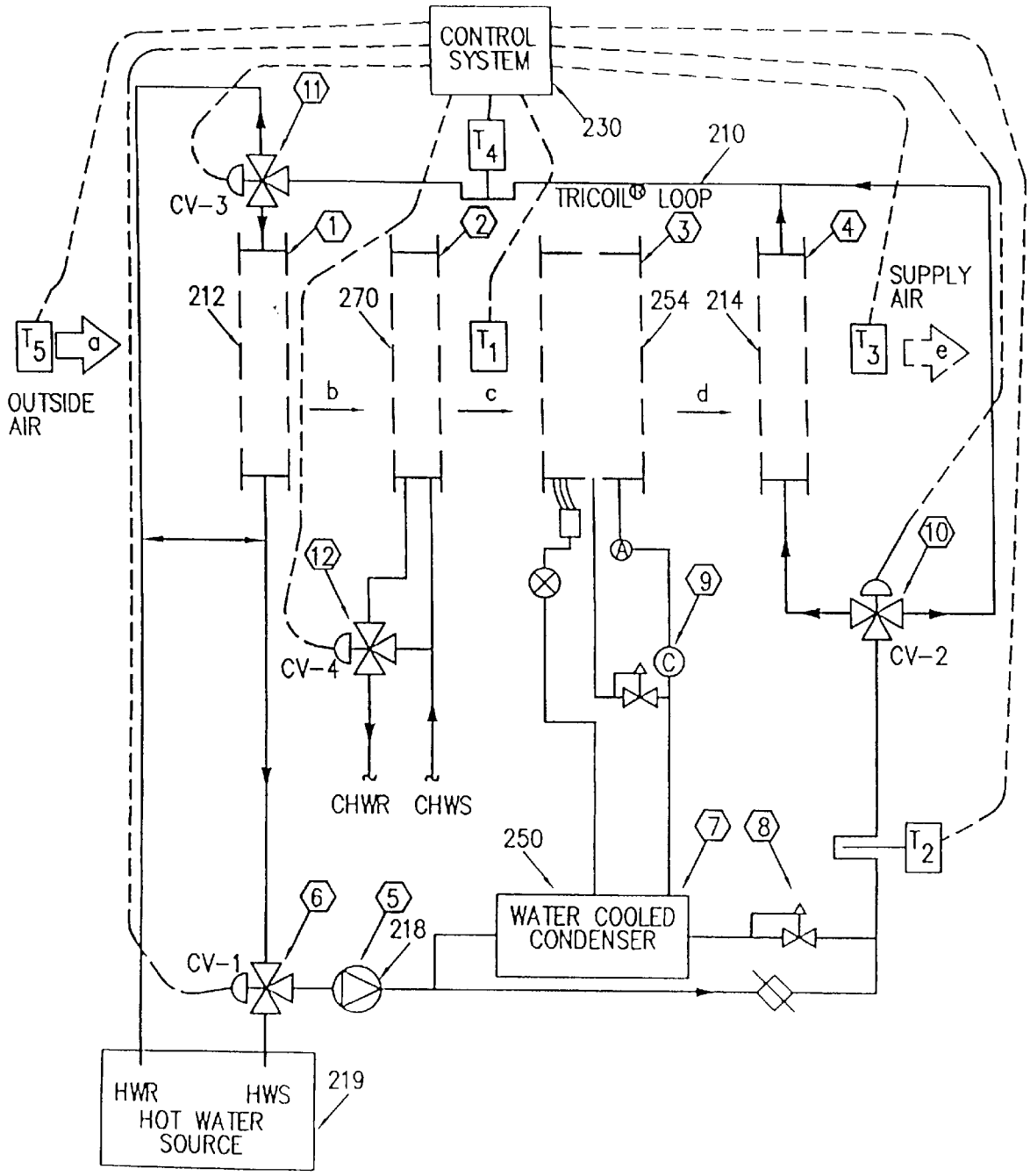
FIG. 17 illustrates a schematic view of a sixth preferred embodiment of the intention for latent heat extraction when used with a water cooled condenser unit type air conditioning system including both a direct expansion cooling coil and a chilled water cooling coil.
Figure 19:
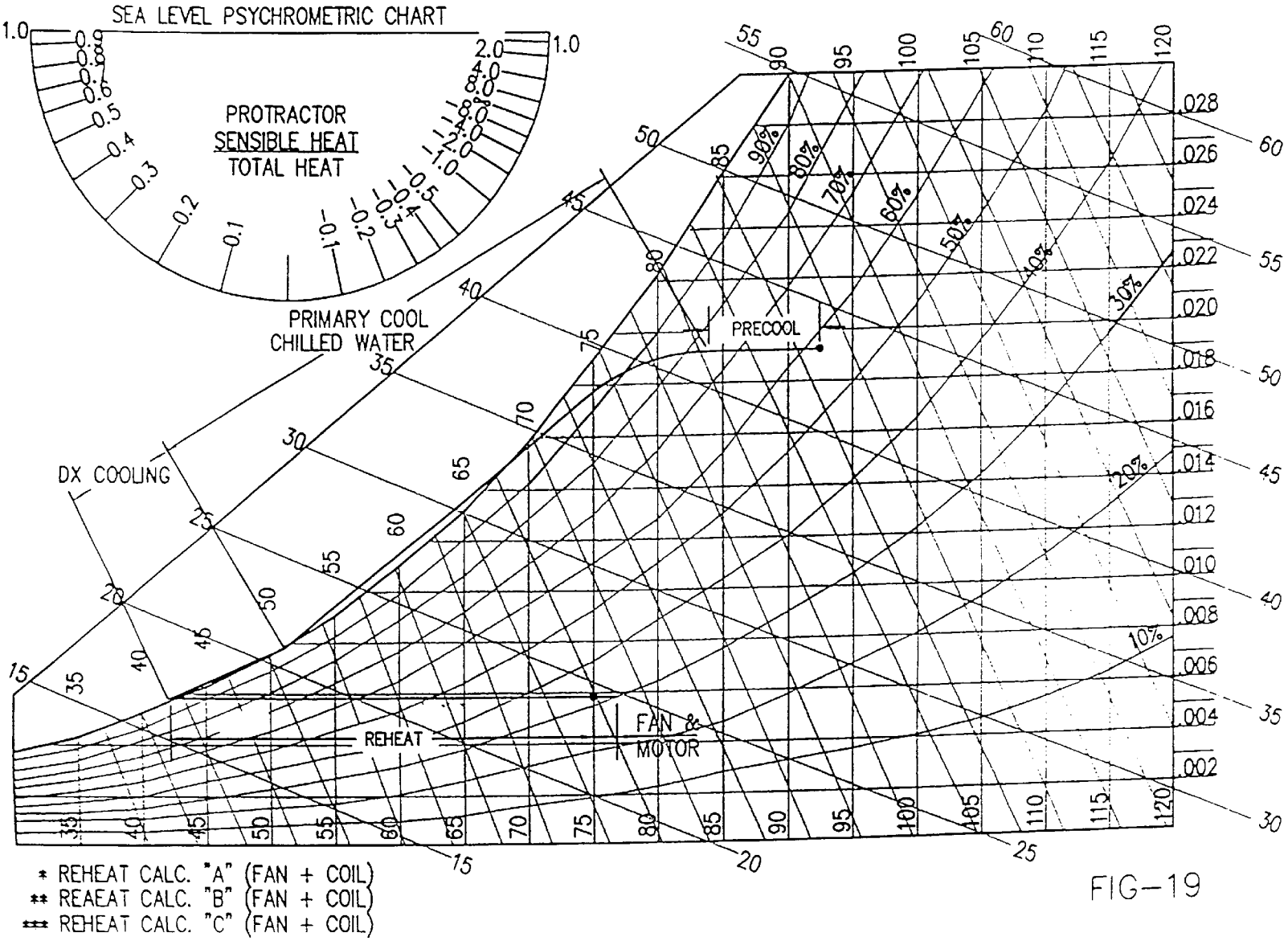
FIG. 19 is a psychometric chart of the embodiment illustrated in FIG. 17; and, FIG. 20 is a psychometric chart of the embodiment illustrated in FIG. 17.
Figure 20:
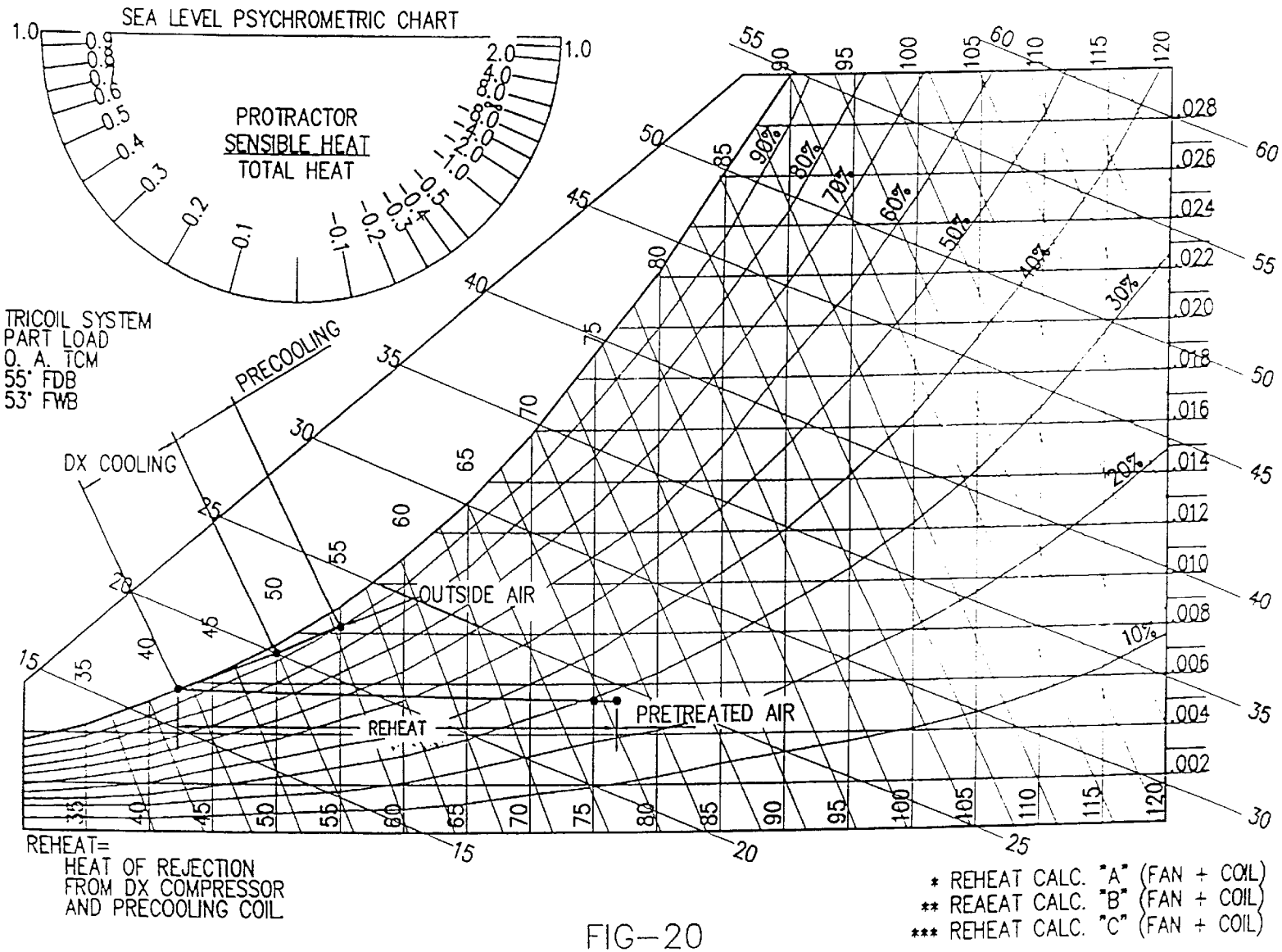

Referring now to FIG. 17, an alternative moisture control apparatus 210 will be described. The apparatus is particularly well suited for conditioning the air in an occupied space using any amount of outside air from 0–100% outside air. The system illustrated provides 77 F. dry bulb supply air at a maximum dew point temperature of 42 F. The system 210 has the ability to maintain this condition during all outside ambient air conditions ranging from winter conditions to summer conditions and between. Lastly, the system illustrated is more efficient than prior art systems providing the same or similar duty cycles and is less expensive. The performance of the embodiment shown is set forth in the psychometric charts forming FIGS. 19 and 20.

Figure 18A:
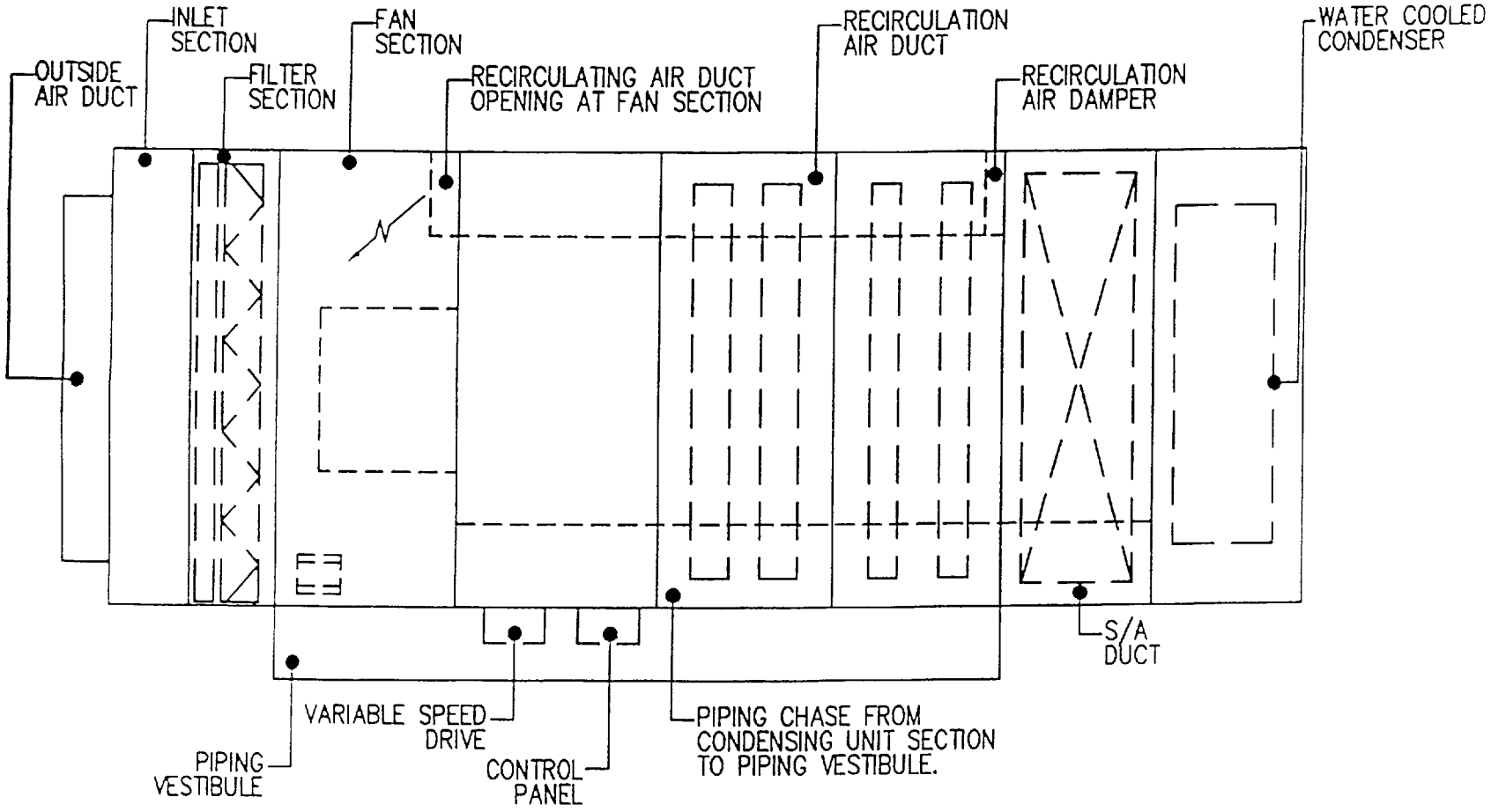
FIGS. 18*a* and 18*b* are plan and elevational views of the air handling unit of the system illustrated in FIG. 17.
Figure 18B:
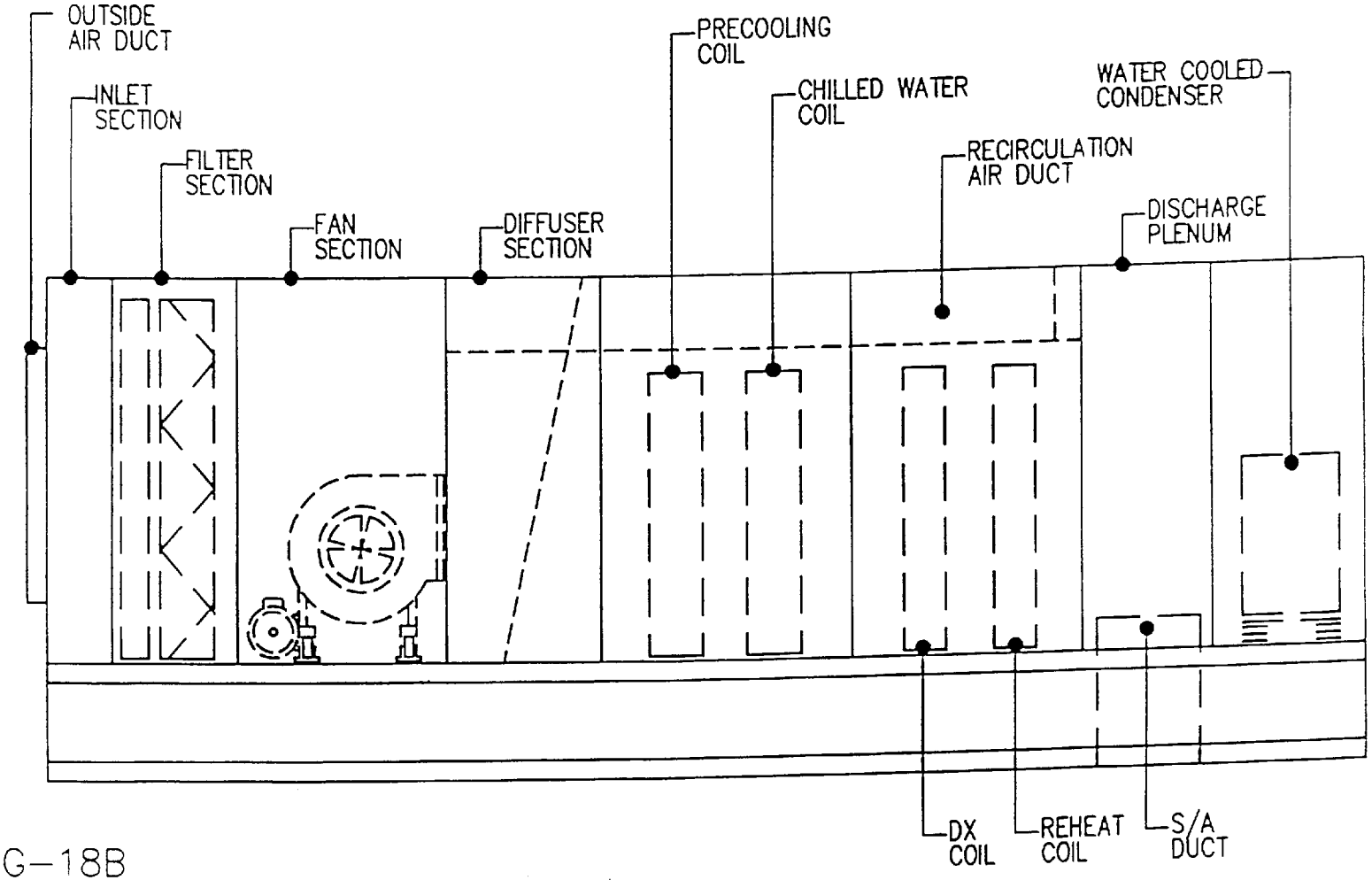

The humidity control system 210 is housed in a suitable air handling unit such as shown in FIGS. 18*a* and 18*b*. The humidity control system consists generally of a precooling water coil 212, a reheat water coil 214, a chilled water primary cooling coil 270, a direct expansion primary cooling coil 254, a water cooled condensing unit 250, a circulating pump 218, control valves CV1, CV2, CV3, CV4, water and refrigerant piping or conduits, a temperature control system 230 and accessories therefore. The air handling unit (FIGS. 18*a*, 18*b*) is of the type available from McQuay and is sold by McQuay completely pre-wired and pre-piped, ready for final wiring and piping connections. The hardware comprising the temperature control unit is preferably an open protocol direct digital control system of the type sold by McQuay. The temperature control system 230 executes a custom control algorithm according to the instant preferred embodiment.

The humidity control system transfers heat from the mixed return and outside air streams a to the supply air stream e thereby providing simultaneous precooling and reheat for temperature and humidity control. The system also provides heating and supplemental reheat control. The operating sequences of the control will be described below.

The pump 218 is preferable a Taco Cartridge Circulator pump or other approved pump having a cast iron or bronze casing, a non-metallic impeller, as ceramic shaft, flanged connections, and a permanent split capacitor motor with overload protection.

Control valves CV1–CV4 are preferably two or three port valves. The preferred valves have bronze bodies with female NPT threads, blowout proof stem design, glass reinforced Teflon thrust washer and stuffing box ring with minimum 400 psi rating. Stem packing screw is preferable adjustable for wear. The valve balls are preferably chromium plated bronze and are rated at a minimum of 400 psi WOG, cold, non-shock service. Each of the valves CV1–CV4 are provided with reinforced Teflon seats.

The control valve actuators (shown in the drawings as an integral part of the valve) are preferably fully modulating or two position type. Modulating valves are positive positioning, responding to a 2–10 VDC or a 4–20 mA command signal from the control 230. In addition, the valves include a visual position indicator and feedback to the controller 230.

With continued reference to FIG. 17, the system illustrated operates similar to the systems described above with the main difference being that in the instant embodiment, the primary cooling is split into two steps. Chilled water cooling is provided by the chilled water cooling coil 270 and direct expansion refrigerant cooling is provided by the direct expansion Dx cooling coil 254. The chilled water is the first cooling step and is used to provide the majority of the cooling and dehumidification. The chilled water cooling coil acts on the air flow b to air flow c up-stream of the direct expansion cooling coil 254. The direct expansion cooling coil lowers the air temperature to conditions below the capability of typical chilled water systems. In this application, the direct expansion system is water cooled. The water in the wrap around loop is used as the condensing medium and absorbs 100% of the latent heat of rejection of the direct expansion system.

The reheat coil 214 is used to heat the supply air stream from flow d to flow e to the desired supply air stream set point conditions. In this preferred embodiment illustrated, there are three sources of reheat energy available, namely energy from the precooling process, heat of rejection from the direct expansion process, and the building's heating hot water system 219 such as gas or electric heat. The direct expansion system capacity is selected such that its heat of rejection is sufficient to provide 100% of the reheat required when the temperature of the air flow c entering the direct expansion coil 254 is at 55 F. as determined by the sensor T1. Lowering the inlet air temperature of the direct expansion air coil reduces the cooling required of the direct expansion system resulting in a reduction in the amount of heat rejected into the wrap around loop. The reheat energy necessary to maintain the supply air temperature is then obtained from either the precooling process or the building's heating hot water source 219. Preference is given to the precooling process as the second heat source because the precooling process not only provides virtually free and renewable reheat energy, but also provides an equivalent reduction in the cooling requirement by the chilled water coil 270.

To facilitate the operation of the system 210 at the various inlet coil conditions, the direct expansion 254 system is provided with multiple steps of refrigeration capacity control. Preferable, one or more compressors are used. The number of compressors in operation is selected by the temperature control system to match the dehumidification load. Each compressor is provided with cylinder unloaders which are controlled in response to changes in the refrigerant suction pressure. On a drop in suction pressure,more steps are activated and on a rise in suction pressure, steps of refrigeration are deactivated. Hot gas by-pass is used as the last step of refrigeration capacity control. The hot gas by-pass control is activated to maintain compressor operation below the last step of cylinder unloading control. In this manner the leaving temperature of the air flow d is maintained at he temperature consistent with the coil suction pressure, preferable, a 42 F. maximum.

Similar to the other preferred embodiments described above, the instant embodiment also includes a precooling coil 212. The precooling operation provides at least two functions: i) the precooling reduces the demand of chilled water required for primary cooling, and 2) provides energy for the reheat function thereby reducing the amount of direct expansion compressor operation needed.

Further according to the instant preferred embodiment, operation of the compressors is not needed during all hours of service. For a considerable period of operation during the year, indoor relative humidity can be controlled with a 50 F. dew point supply air a temperature, instead of the 42 F. dew point temperature. During these operating periods, the recuperative wrap around loop of this embodiment provides precooling and reheat as do the systems of the other preferred embodiments described above.

The preferred method of operating the system of FIG. 17 based on 100% outside air and a 42 F. dew point with internal air circulation, will now be described.

TRICOIL system Operating Sequence

The following operating sequence is for a 2-Step TRICOIL® System, with 42 degree dew point capability.

1. TRICOIL® 100% Outside Air System with 42 Degree Dewpoint and Internal Air Recircualtion.

A. The TRICOIL® system shall be provided with an Energy Management and Control System (EMCS) that shall provide the control functions and interface to the facility's Building Management System (BMS).

B. On/Off and Status.

1. Each AHU and controls shall be enabled/disabled by the BMS. Unit controls shall operate automatically when energized.
2. Operate the air handling unit fan continuously subject to safety override when the system controls are enabled. Stop the air handling unit fan when the controls are disable by the BMS.
3. The fan motor shall stop and the temperature controls shall be disabled on a signal from the fire alarm system. The control system shall be enabled and the fan shall start automatically when the alarm signal is cleared.
4. Indicate fan and pump status through a differential pressure switch. Indicate an alarm condition (after a suitable time delay) when the fan or pump fails to start or stops when it is scheduled to be operating.
5. Indicate filter status through a differential pressure switch. Indicate an alarm condition when the filter differential pressure rises above the desired filter change-out setpoint.
6. Provide floating point alarms for temperature and humidity inputs.

C. Air Volume Control:

1. Modulate the fan speed to maintain a fixed supply air static pressure.
2. Position the by-pass damper to maintain a constant minimum air flow across the coils. Incrementally open the damper as interior air handling units are deactivated and Incrementally close the damper as interior air handling units are activated.

D. First Primary Step Cooling, Chilled Water:

1. Modulate the chilled water valve to maintain the leaving chilled water coil air temperature (T1) at set point (50 degrees). Open the valve on a rise in temperature and close the valve on a fall in temperature.
2. Reset the setpoint up on a demand for additional reheat energy. See Reheat Control for requirements.

E. Second step of Cooling, Direct Expansion:

1. The compressor will operate continuously when the fan is operating and there is a demand for indoor dehumidification and the outside air temperature is above 45 degrees. Determination of the building's dehumidification requirement shall be through the BMS.
2. The refrigeration system is provided with suction pressure activated cylinder unloaders and hot gas by-pass control for refrigeration capacity control F. Reheat Control:

1. Modulate valve CV-2 to maintain the supply air temperature (T3) at setpoint. Open the valve to the coil on a drop in supply air temperature and closed to the coil on a rise in temperature.
2. On a continued drop in supply air temperature at T-3 reset the air temperature leaving the chilled water coil up. On a rise in supply air temperature at T-3 reset the supply air temperature down. Reset Limits: 50 degrees low and 55 degrees high.
   a) The purpose of this control is to maintain the leaving reheat coil temperature at a minimum of 75 degrees. As the air temperature leaving the reheat coil drops the air temperature entering the direct expansion coil will be caused to rise thereby increasing the amount of cooling required by the direct expansion system to maintain the 42 degree dew point. The increased cooling load increases the heat of rejection to the TRICOIL loop thereby increasing the heat available for reheat resulting in a rise in supply air temperature.

3. On a continued drop in supply air temperature at T3 control valve CV-1 shall modulate to maintain the setpoint at T3. CV-1 shall modulate open to the hot water source on a drop in temperature and closed to the source on a rise in temperature.
   a) The operation of this valve automatically replaces part of the heat of rejection from the refrigeration system. This operation will only be required to maintain the supply air temperature at 75 degrees when the outside air temperature is below 55 degrees.

G. Precooling Control:
1. Position valve CV-3 for full flow through the precooling coil when the outside air temperature (T-5) is above the entering water temperature (T-4).
2. Position valve CV-3 for full flow through the coil by-pass when the outside air temperature at (T-5) is below the temperature of the water at (T-4). This control function will preclude the preheating of the air stream when the water temperature is warmer than the air temperature.
3. Precooling is available with and with out compressor operation. Control of valve CV-3 is identical when the compressor is On or Off.

H. Freeze protection:
1. When the outside air temperature is below 40 degrees the TRICOIL system shall be placed in the freeze protection mode. Refrigeration compressors shall be off and the chilled water valve shall be closed during this mode of operation.
2. Position control valve CV-2 to by-pass 100% of the TRICOIL loop flow around the reheat coil and position CV-3 for 100% flow through the precooling coil which will now be used as a preheat coil. Modulate CV-1 to maintain the desired setpoint at T1 (40 degrees). CV-1 shall modulate open to the hot water source on a drop in air temperature and closed to the source on a rise in air temperature.

The invention has been described with reference to the preferred embodiments. Obviously modifications and alterations will occur to others upon a reading and understanding of this specification. It is my intention to include all such modifications and alterations insofar as they come within the scope of the appended claims and equivalents thereof.

Having thus described the invention, I now claim:

1. A moisture control and freeze preventing apparatus adapted for use with an air conditioning system having a chilled water cooling coil where chilled water in the chilled water cooling coil absorbs thermal energy from a return air flow as a cooled supply air flow, the moisture control apparatus comprising:

a controller apparatus;

a working fluid;

a precooling coil in said return air flow for exchanging thermal energy between the return air flow and the working fluid;

a return air flow temperature sensor in said return air flow for determining the temperature of the return air flow and generating a return air flow temperature signal for use by said controller apparatus;

a reheat coil in said supply air flow for exchanging thermal energy between the working fluid and the supply air flow;

a thermal energy source for adding thermal energy to the working fluid;

a control valve responsive to a command signal from the controller apparatus for i) directing the working fluid through a series arrangement of said reheat coil and said precooling coil when the command signal is in a first state and ii) directing the working fluid exclusively through said precooling coil bypassing said reheat coil when the command signal is in a second state; and, a fluid pump for motivating a flow of the working fluid through said a thermal energy source to said control valve.

* * * * *